US007219446B1

(12) United States Patent
Haimerl

(10) Patent No.: US 7,219,446 B1
(45) Date of Patent: May 22, 2007

(54) FOOTWEAR WITH SEALED SOLE CONSTRUCTION AND METHOD FOR PRODUCING SAME

(76) Inventor: Franz Haimerl, Egerländerstr. 2, D - 82393 Iffeldorf (DE)

( * ) Notice: Subject to any disclaimer, the term of this patent is extended or adjusted under 35 U.S.C. 154(b) by 0 days.

(21) Appl. No.: 10/069,057

(22) PCT Filed: May 8, 2000

(86) PCT No.: PCT/EP00/04113

§ 371 (c)(1),
(2), (4) Date: Sep. 3, 2002

(87) PCT Pub. No.: WO01/12002

PCT Pub. Date: Feb. 22, 2001

(30) Foreign Application Priority Data

Aug. 16, 1999 (EP) ..... 199 38 139

(51) Int. Cl.
*A43C 13/08* (2006.01)

(52) U.S. Cl. ..... 36/12; 36/14; 12/142 T

(58) Field of Classification Search ..... 36/12, 36/14, 19.5, 17 R, 22 R, 30 R; 12/142 RS, 12/142 T
See application file for complete search history.

(56) References Cited

U.S. PATENT DOCUMENTS 5,019,638 A * 5/1991 Muller et al. ..... 528/83
5,285,546 A * 2/1994 Haimerl ..... 12/142 E
5,678,326 A * 10/1997 Pavelescu ..... 36/14
5,689,903 A * 11/1997 Aumann ..... 36/77 R
5,939,488 A * 8/1999 Nowicki et al. ..... 525/59
5,943,791 A * 8/1999 Pavelescu et al. ..... 36/14
6,035,555 A * 3/2000 Pavelescu et al. ..... 36/14
6,087,463 A * 7/2000 Tada et al. ..... 528/45
6,845,572 B1 * 1/2005 Haimerl et al. ..... 36/12

FOREIGN PATENT DOCUMENTS

| | | | |
|---|---|---|---|
| DE | 3840263 A | | 5/1990 |
| EP | 0298360 B | | 1/1989 |
| WO | 94/04576 | * | 3/1994 |
| WO | WO96/41548 A | | 12/1996 |
| WO | WO00/44252 A | | 8/2000 |

* cited by examiner

*Primary Examiner*—Marie Patterson
(74) *Attorney, Agent, or Firm*—Kevin J. Boland

(57) ABSTRACT

Footwear with an upper and a sole construction having an outsole, in which the upper is constructed with an outer material and with a waterproof functional layer at least partially lining the outer material on the inner side of the latter and having an upper end region on the sole side with an outer-material end region and a functional-layer end region, the outsole (19) is joined to the upper end region, the functional-layer end region has an overhang projecting beyond the outer-material end region and an adhesive zone which is closed in the direction of the sole periphery and comprises a reactive hot-melt adhesive which brings about waterproofness when in the fully reacted state is applied to the overhang.

69 Claims, 26 Drawing Sheets

FIG. 22
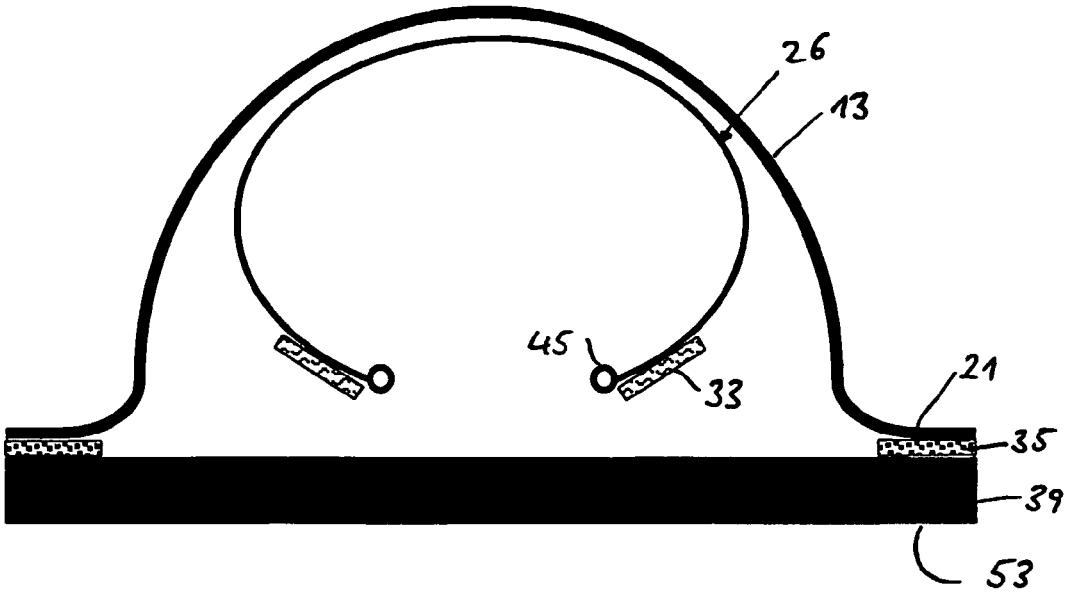
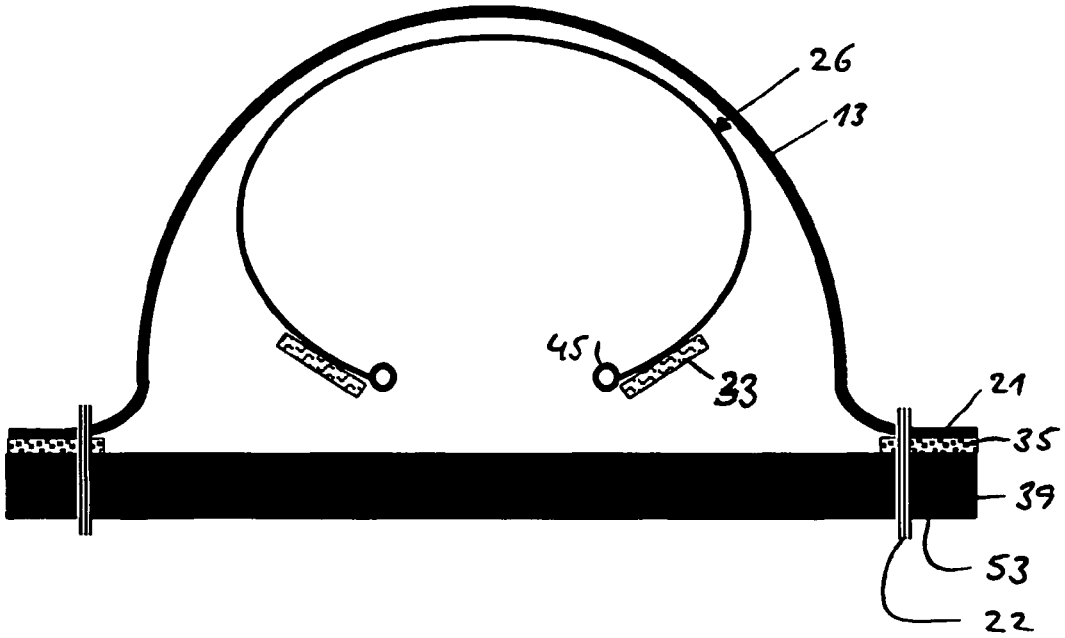
FIG. 23

FIG. 24
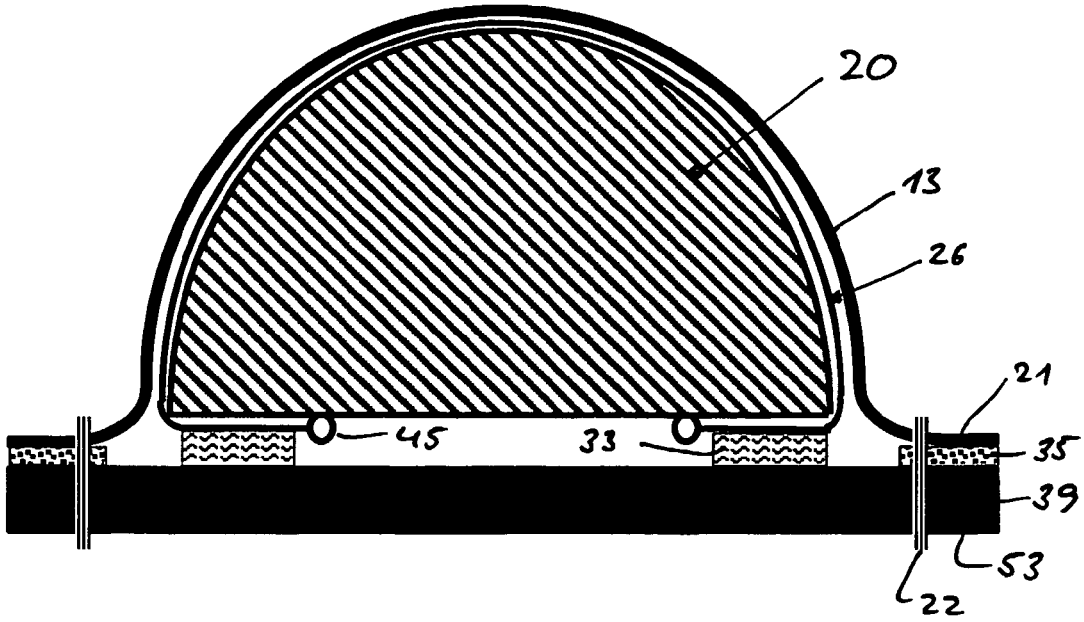
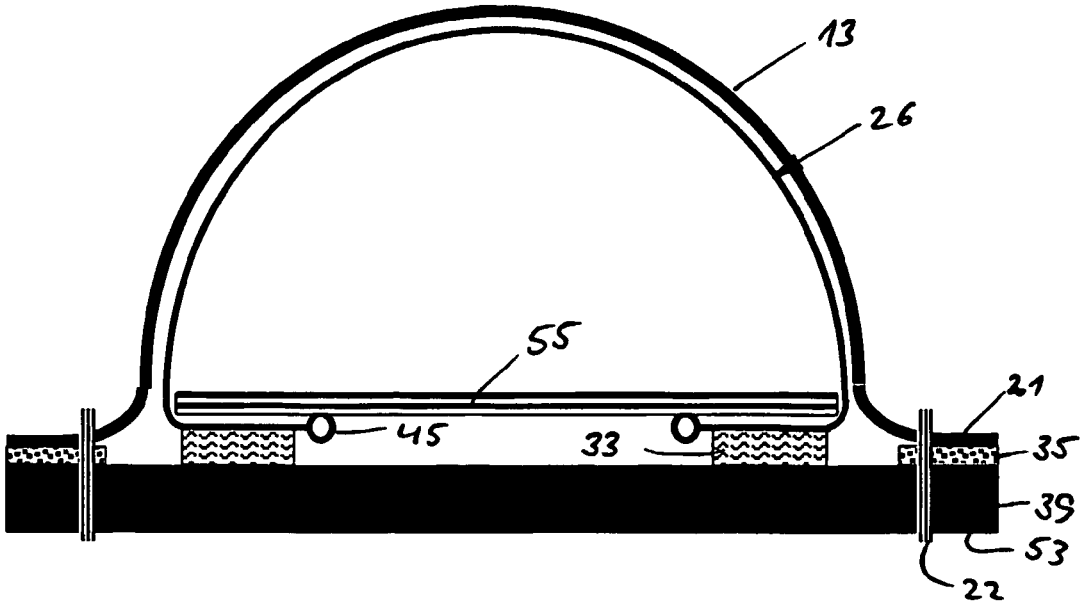
FIG. 25

FIG. 26
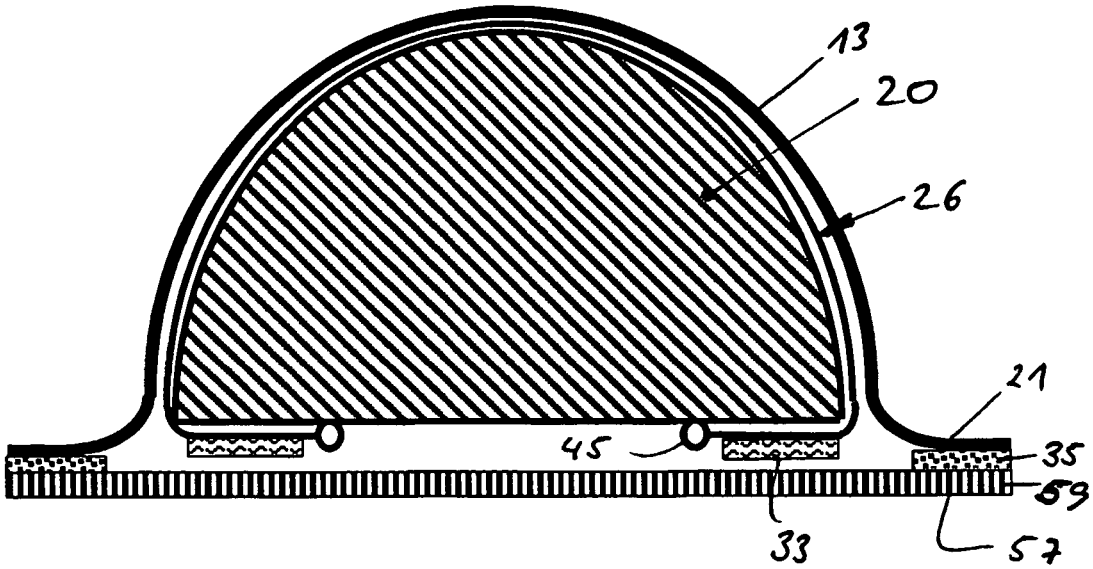
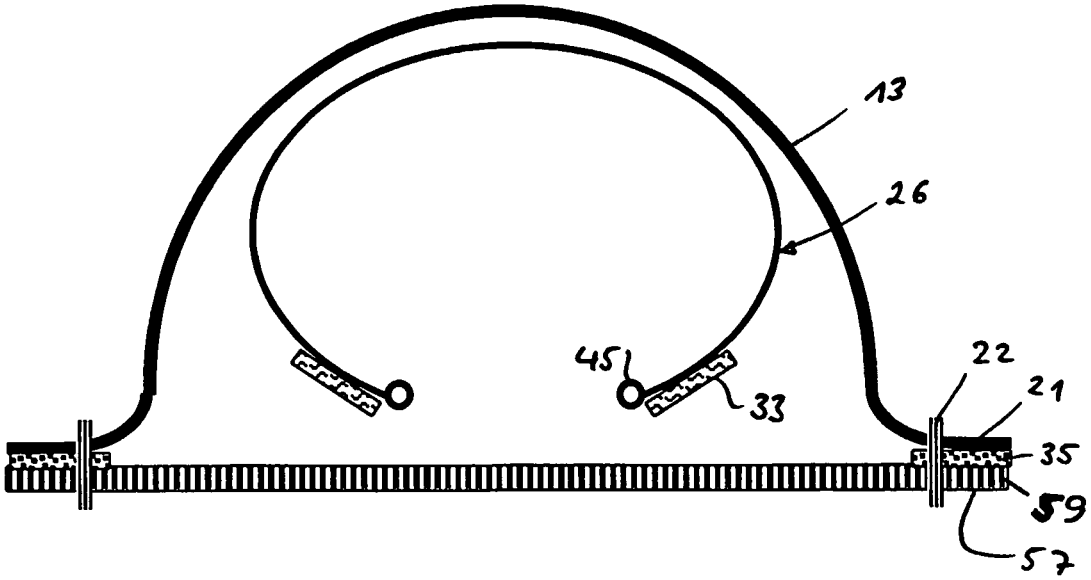
FIG. 27

FIG. 28
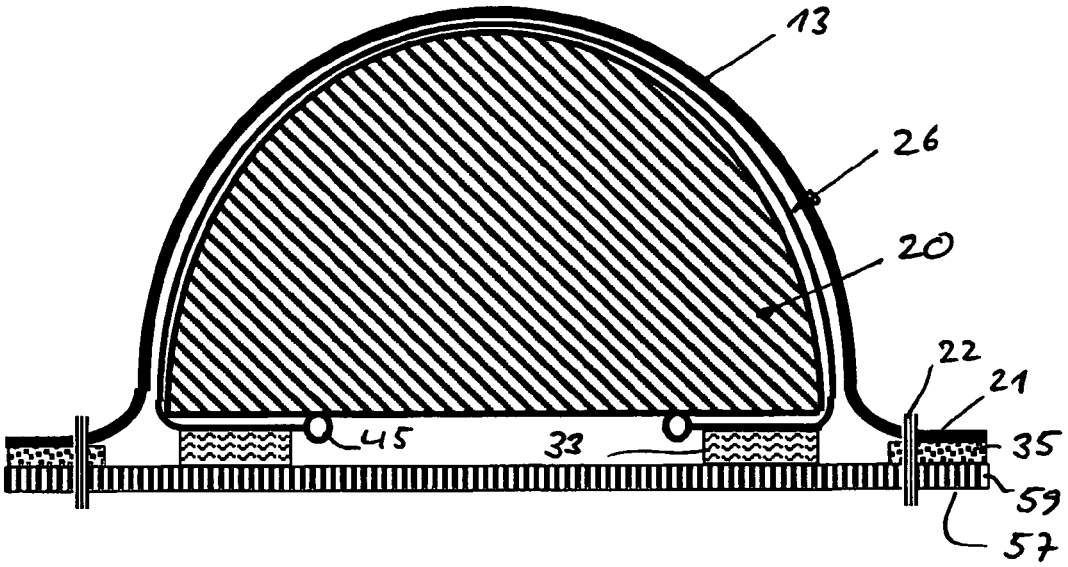
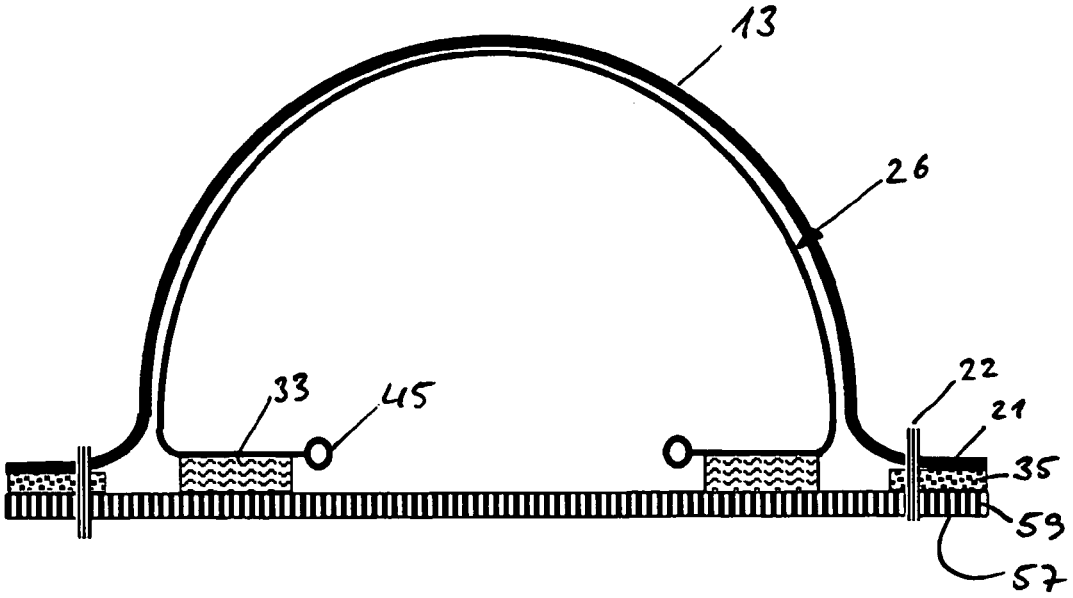
FIG. 29

FIG. 30
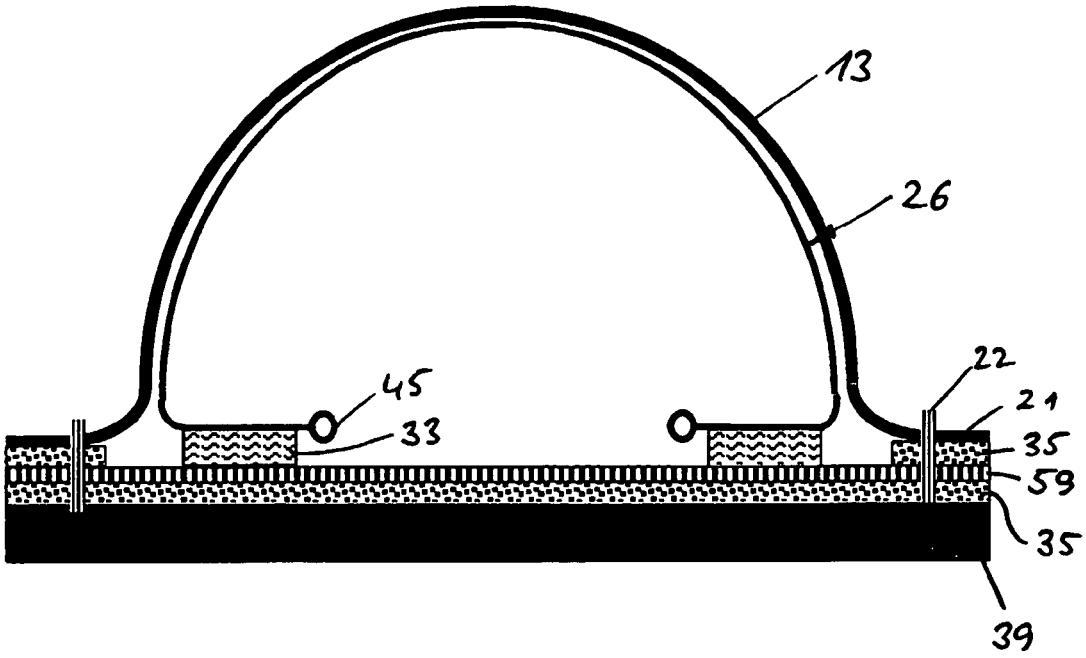
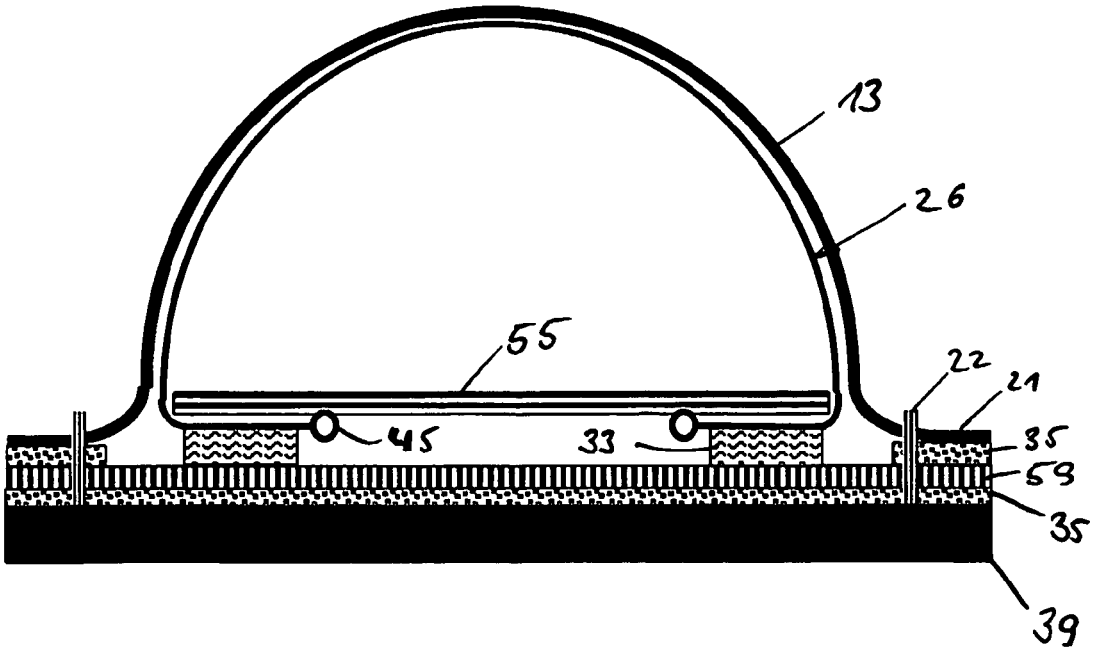
FIG. 31

FOOTWEAR WITH SEALED SOLE CONSTRUCTION AND METHOD FOR PRODUCING SAME

This application is a 371 of PCT/EP00/04113 filed May 8, 2000.

FIELD OF THE INVENTION

The invention relates to footwear with an upper, which is provided at least partially with a waterproof functional layer which is preferably water-vapor permeable, and with an outsole, in particular a cemented-on outsole. The invention also relates to a process for the production of such a shoe.

TECHNICAL BACKGROUND

There are shoes whose shoe upper is waterproof and water-vapor permeable because it is lined with a functional layer. A shoe upper of this type remains breathable in spite of being waterproof. Special efforts are required to ensure permanent waterproofness in the region between the end of the upper on the sole side and the sole construction.

To achieve this, sock-like inserts, also known among those skilled in the art as bootees, have been used between the upper and the sole construction on the one hand and an inner lining on the other hand. Since such bootees are shaped by fusing together cut-to-size parts, they need not have any stitching holes. However, the use of bootees is quite costly in production if the bootees are to correspond to some extent to the shape of the respective shoe.

Another known method is to use outsole material of a molded-on outsole to seal the lower region of the shoe construction, and consequently the lower region of the upper lined with the functional layer and possibly sewn to an insole. This cannot, however, prevent water from reaching the end of the upper on the sole side, and consequently the end of the functional layer on the sole side, on the outer material of the upper, which generally conducts water by capillary effects, and consequently reaching the generally very strongly water-absorbent inner lining located on the inner side of the functional layer, via water bridges, in particular in the form of textile fibers at the cut edge of the end of the upper on the sole side.

These problems have been overcome by a sole construction known from EP 0 298 360 B1, in which the functional layer has in the region of the end of the upper on the sole side an overhang with respect to the outer material, which is bridged by a gauze strip, of which one side is securely sewn to the outer material and the other side is securely sewn to the functional layer and to the insole. In this case, the overhang of the functional layer is sealed by the outsole material which has penetrated through the gauze strip during the molding-on, when it is liquid. The gauze strip represents a barrier to water which has penetrated along the outer material to under the region of the end of the upper on the sole side covered by the outsole, in particular if it is a monofilament gauze strip, so that such water cannot penetrate as far as the cut edge of the functional layer on the sole side and consequently not as far as the inner lining of the footwear.

This gauze strip solution has proven to be extremely successful. Since in this case the sealing of the end region of the functional layer on the sole side requires the molding-on of an outsole, this known method is restricted to shoes with a molded-on outsole and cannot be used for shoes with a cemented-on outsole. Consequently, it is also not available for shoes of a more elegant style. The molding-on of outsoles entails high costs, which lead to a long payback period and make it necessary to produce the respective type and size of shoe in large numbers.

DE-A-38 40 263 discloses a similar shoe construction in which an overhang of an end of a functional layer on the outsole side protruding with respect to an end of the outer material on the outsole side is bridged by a sealing strip, in which the strip is a textile strip which has a polyurethane coating on one or both sides and is intended to bring about a sealing connection between the functional layer overhang and an edge of a moulded-on outsole covering the sealing strip. This solution is also restricted to shoes with a moulded-on outsole.

WO-A-9641548 discloses footwear with a moulded-on outsole in which an outer-material end region on the outsole side is folded over outward and an functional-layer-lining end region on the outsole side is folded over inward, the outer-material end region which is folded over folded over outward being securely sewn on a frame-shaped first insole and the functional-layer-lining end region which is folded over inward being arranged between the first insole and a second insole, located above the functional-layer-lining end region. The functional-layer-lining end region is adhesively bonded to the second insole by means of a sealing compound or adhesive tape coated with polyurethane hot-melt adhesive and to the second insole by means of an adhesive of a type not specified any more precisely.

Shoe constructions in which the functional layer likewise has an overhang beyond the outer material in the end region on the sole side, but in which there is no gauze strip, are likewise known. In this case, the outsole material is molded directly onto the functional layer in the region of the overhang. This method is also suitable only for footwear with a molded-on outsole.

SUMMARY OF THE INVENTION

The invention provides footwear in which, with any outsole, the upper end region on the sole side can be made permanently waterproof with as little expenditure as possible and with as few process steps as possible.

Footwear according to the invention has an upper and an outsole, the upper being constructed with an outer material and with a waterproof functional layer at least partially lining the outer material on the inner side of the latter and having an upper end region on the sole side with an outer-material end region and a functional-layer end region. The outsole is joined to the upper end region. The functional-layer end region has an edge region which is not covered by the outer material end region. In an embodiment of the invention this edge region is formed by an overhang projecting beyond the outer-material end region. An adhesive zone which is closed in the direction of the sole periphery and comprises a reactive hot-melt adhesive which brings about waterproofness when in the fully reacted state is applied to the edge region or overhang.

The sealing function which in the case of conventional footwear of the type specified above has been achieved with outsole material is brought about in the case of footwear according to the invention by the reactive hot-melt adhesive applied to the overhang of the functional-layer end region, which on the one hand has particularly high creepability in the liquid state before fully reacting and on the other hand leads to particularly high and permanent waterproofness when in the fully reacted state. The reactive hot-melt adhesive can be applied with very simple means, for example be brushed on, sprayed on or applied in the form of an adhesive strip or an adhesive bead, the reactive hot-melt adhesive allowing itself to be made adhesive, and thereby fixed to the overhang, by heating, before the process of fully reacting and associated permanent adhesive bonding with the functional layer begins in the region of its overhang.

The waterproofness of the sole construction of waterproof footwear with any outsole is consequently achieved in an extremely simple way and with extremely simple process steps. The method according to the invention therefore leads to low production costs for waterproof shoes.

In an embodiment of the invention, the upper end region extends essentially perpendicular to the tread of the outsole (hereafter also referred to as vertical extent) and the functional-layer end region projects beyond the outer-material end region in the direction of the tread. In another embodiment of the invention, the upper end region extends essentially parallel to the tread of the outsole (hereafter also referred to as horizontal extent) and the functional-layer end region extends beyond the outer-material end region in the direction of the center of the outsole. The first embodiment is particularly suitable for dish-like outsoles, which have an edge turned up perpendicular to the tread of the outsole. The latter embodiment is particularly suitable for shoes with flat sheet-like outsoles, as are used in particular for more elegant shoes.

In an embodiment of the invention, the overhang is bridged by means of a connecting strip, the one longitudinal side of which is joined to the outer-material end region and the other longitudinal side of which is joined to the functional-layer end region. In another embodiment of the invention, there is no such bridging of the overhang.

The reactive hot-melt adhesive in the region of the overhang is applied either directly to the functional layer, if there is no connecting strip, or it is applied to the outer side of the connecting strip bridging the overhang if a connecting strip is present. In order that, in the latter case, a reactive hot-melt adhesive seals the functional layer, a material which is permeable to the reactive hot-melt adhesive, which is liquid or liquefied before fully reacting, is chosen for the connecting strip.

The presence of such a connecting strip on the one hand allows permanent waterproof sealing between the functional-layer end region and the cemented-on outsole and on the other hand makes it possible for the tensile forces which are exerted on the functional layer during the stretching of the functional-layer end region over the last, for example by means of string lasting or by means of clamps, to be directed fully or at least partially to the outer material, instead of allowing them to act exclusively on the functional layer, which is less able to withstand loads.

The connecting strip is preferably constructed with open-mesh material, which is formed by thermoplastic mesh material or textile material, preferably monofilament textile material. The connecting strip may, however, be of any other form, for example be formed by clasps, large-looped or long seam stitches or similar structures. The connecting strip is intended mainly to perform the task of permitting adequate flow of the liquid reactive hot-melt adhesive for permanently waterproof sealing of the functional layer and to allow the functional layer to be relieved of forces and the load to be transferred or divided between the outer material and the insole material (in the case of cement-lasting) or the string-lasting (in the case of string-lasting).

A gauze strip from Gebrüder Jaeger GmbH & Co. of Wuppertal, Germany, with the article number 23851, is suitable for footwear according to the invention.

The invention is suitable for footwear with an insole or footwear without an insole. In the latter case, the functional-layer end region on the sole side is lashed together by means of string-lasting. In this case, the outer-material end region is cemented or securely sewn to the functional-layer end region, possibly via a gauze strip, or the functional-layer end region and the outer-material end region are each lashed together by means of a string-lasting of their own.

In particular in the case of shoe constructions in which it is difficult or, due to lack of accessibility, impossible to lash together the string of the string-lasting at the time at which the tensioning of the string-lasting is required, an elastic means is advantageously used, for example in the form of an elastic string-lasting with an elastic string, which pretensions the functional-layer end region in the direction of the center of the outsole.

In an embodiment of the invention with a gauze strip, one longitudinal side of the said gauze strip is joined, preferably by sewing, to the outer-material end region and its other longitudinal side is joined to the functional-layer end region and possibly to the insole.

In a process according to the invention for producing footwear according to the invention, the following procedure is followed:

an upper is created, constructed with an outer material and with a waterproof functional layer at least partially lining the outer material on the inner side of the latter and provided with an upper end region on the sole side. The outer material is provided with an outer-material end region on the sole side and the functional layer is provided with a functional-layer end region on the sole side, the functional-layer end region being provided with an edge region which is not covered by the outer material. In an embodiment of the invention, this edge region is formed by an overhang of the functional-layer end region projecting beyond the outer-material end region. An adhesive zone which is closed in the direction of the sole periphery and comprises a reactive hot-melt adhesive which brings about waterproofness when in the fully reacted state is applied to the edge region or overhang. An outsole is fastened to the upper end region.

The adhesive bonding of the reactive hot-melt adhesive with the functional layer becomes particularly intimate if, after being applied to the overhang, the reactive adhesive is mechanically pressed against the functional layer. Preferably suitable for this purpose is a pressing device, for example in the form of a pressing pad, with a smooth material surface which cannot be wetted by the reactive hot-melt adhesive and therefore cannot bond with the reactive hot-melt adhesive, for example of non-porous polytetra-fluoroethylene (also known by the trade name Teflon). Preferably used for this purpose is a pressing pad, for example in the form of a rubber pad or air cushion, the pressing surface of which is covered with a film of the said material, for example non-porous polytetrafluoroethylene, or such a film is arranged between the sole construction provided with the reactive hot-melt adhesive and the pressing pad before the pressing operation.

In one embodiment of the invention, the outsole is adhesively attached with conventional solvent adhesive or hot-melt adhesive, polyurethane-based adhesives being concerned here for example. Solvent adhesive is an adhesive which has been made adhesive by the addition of vaporizable solvent and cures on the basis of the vaporizing of the solvent. Hot-melt adhesive is an adhesive, also known as thermoplastic adhesive, which is brought into an adhesive state by heating and cures by cooling. Such adhesive can be repeatedly brought into the adhesive state by renewed heating.

A reactive hot-melt adhesive which can be cured by means of moisture is preferably used, being applied to the region to be adhesively attached and being exposed to moisture to make it fully react. In one embodiment of the invention, a reactive hot-melt adhesive which can be thermally activated and can be cured by means of moisture is used, being thermally activated, applied to the region to be adhesively attached and exposed to moisture to make it fully react.

The production of shoes according to the invention is made particularly simple and cost-effective by using reactive hot-melt adhesive which can be thermally activated and can be induced to undergo its curing reaction by means of moisture, for example water vapor.

Expanding reactive hot-melt adhesive may also be used if use is to be made of its increased volume, which makes it particularly suitable for filling cavities and penetrating into cracks or niches which may form in the region of the gauze strip. Particularly reliable waterproofness can be brought about as a result. Expansion may be achieved by the reactive hot-melt adhesive being made to swirl by a gas, which may preferably be a mixture of nitrogen and air, during application.

Reactive hot-melt adhesives refer to adhesives which, before their activation, consist of relatively short molecule chains with an average molecular weight in the range from about 3000 to about 5000 g/mol, are non-adhesive and, after activating, possibly by heat, are brought into a state of reaction in which the relatively short molecule chains are crosslinked to form long molecule chains and thereby cure, doing so predominantly in moist atmosphere. During the reaction or curing time, they are adhesive. After the crosslinking curing, they cannot be re-activated. When they fully react, a three-dimensional crosslinking of molecule chains occurs. The three-dimensional crosslinking leads to particularly strong protection against penetration of water into the adhesive.

Suitable for the purpose according to the invention are, for example, polyurethane reactive hot-melt adhesives, resins, aromatic hydrocarbon resins, aliphatic hydrocarbon resins and condensation resins, for example in the form of epoxy resin.

Particularly preferred are polyurethane reactive hot-melt adhesives, referred to hereafter as PU reactive hot-melt adhesives.

The crosslinking reaction bringing about the curing of PU reactive hot-melt adhesive is usually brought about by moisture, for which atmospheric moisture is adequate. There are blocked PU reactive hot-melt adhesives of which the crosslinking reaction can only begin after activation of the PU reactive hot-melt adhesive by means of thermal energy, so that such hot-melt adhesive can be stored in the open, i.e. surrounded by atmospheric moisture. On the other hand, there are non-blocked PU reactive hot-melt adhesives, in which a crosslinking reaction takes place at room temperature if they are surrounded by atmospheric moisture. The latter reactive hot-melt adhesives must be kept in such a way that they are protected from atmospheric moisture as long as the crosslinking reaction is not yet to take place.

In the unreacted state, both types of PU reactive hot-melt adhesives are usually in the form of rigid blocks. Before applying to the regions to be cemented, the reactive hot-melt adhesive is heated in order to melt it and consequently make it able to be spread or applied. If non-blocked reactive hot-melt adhesive is used, such heating must be performed with the exclusion of atmospheric moisture. If blocked reactive hot-melt adhesive is used, this is not necessary, but it must be ensured that the heating temperature remains below the deblocking activation temperature.

In one embodiment of the invention, PU reactive hot-melt adhesive which is constructed with blocked or capped isocyanate is used. To overcome the isocyanate blocking and consequently to activate the reactive hot-melt adhesive constructed with the blocked isocyanate, a thermal activation must be carried out. Activation temperatures for such PU reactive hot-melt adhesives lie approximately in the range from 70° C. to 180° C.

In another embodiment of the invention, non-blocked PU reactive hot-melt adhesive is used. The crosslinking reaction can be accelerated by supplying heat.

In a practical embodiment of the method according to the invention, a PU reactive hot-melt adhesive which can be obtained under the name IPATHERM S 14/242 from the company H.P. Fuller of Wels, Austria is used. In another embodiment of the invention, a PU reactive hot-melt adhesive which can be obtained under the name Macroplast QR 6202 from the company Henkel AG, Düsseldorf, Germany, is used.

In an embodiment of the invention, reactive hot-melt adhesive is used, which may be the already mentioned PU reactive hot-melt adhesive with admixed carbon particles, metal particles with electrical conductivity or particles of other materials which have an electrical conductivity of such a type that they can be selectively heated by means of microwave energy, or which have an absorbency for other types of radiation, for example infrared radiation, of such a type that they can be selectively heated by means of such radiation. As a result of the energy absorption, the particles admixed with the reactive hot-melt adhesive heat up and cause the reactive hot-melt adhesive to be heated "from the inside out". In this process, the particles act like "heating elements" incorporated into the reactive hot-melt adhesive. Suitable selection of the heating energy allows the effect to be achieved that materials of the shoe construction other than the reactive hot-melt adhesive do not heat up, or only relatively little. The particles are, for example, in a fibrous form. The carbon particles are admixed with the reactive hot-melt adhesive with a proportion by weight in the range from about 0.1%0 to about 5%0, preferably in the range from about 0.1%0 to about 3%0 and particularly preferably with a proportion by weight of 2%0. For metal particles, approximately the same admixing amounts apply. In an embodiment using this reactive hot-melt adhesive, an adhesive mixture of this type is applied to the location to be adhesively bonded before the adhesive bonding operation. The footwear then undergoes an activation heating process, for example by means of microwave energy, ultrasound or infrared heating. This heating is adjusted such that heating up of the carbon particles, metal particles or energy-absorbing particles of another kind takes place, as a result of which the reactive hot-melt adhesive is activated and liquefied. In the case of infrared heating, for example, it is possible by the selective use of certain wavelengths to exclude the possibility of any more than just the reactive hot-melt adhesive being heated. Heating the reactive hot-melt adhesive by means of the incorporated energy-absorbing particles consequently achieves the effect of saving the other components of the footwear from being excessively heated. These incorporated particles also allow a reduction in the required exposure time in the heating of the reactive hot-melt adhesive to be achieved.

Particularly preferred is a functional layer which is not only water-impermeable but also water-vapor permeable. This makes possible the production of waterproof shoes which remain breathable in spite of being waterproof.

A functional layer is regarded as "waterproof", if appropriate including the seams provided at the functional layer, if it ensures a water ingress pressure of at least $1.3 \cdot 10^4$ Pa. The material of the functional layer preferably ensures a water ingress pressure of over $1 \cdot 10^5$ Pa. The water ingress pressure must be measured here by a test method in which distilled water at 20±2° C. is applied with increasing pressure to a sample of the functional layer of 100 $cm^2$. The pressure increase of the water is 60±1 cm of water column per minute. The water ingress pressure then corresponds to the pressure at which water appears for the first time on the other side of the sample. Details of the procedure are described in ISO standard 0811 from the year 1981.

A functional layer is regarded as "water-vapor permeable" if it has a water-vapor permeability coefficient Ret of less than 150 $m^2 \cdot Pa \cdot W^{-1}$. The water-vapor permeability is tested by the Hohenstein skin model. This test method is described in DIN EN 31092 (02/94) or ISO 11092 (19/33).

Whether a shoe is waterproof can be tested for example by a centrifuge arrangement of the type described in U.S. Pat. No. 5,329,807. A centrifuge arrangement described there has four swing-mounted holding baskets for holding footwear. With this arrangement, two or four shoes or boots can be tested at the same time. In this centrifuge arrangement, centrifugal forces generated by centrifuging the footwear at high speed are used for locating leaks in the footwear. Before centrifuging, the space inside the footwear is filled with water. Absorbent material, such as blotting paper or a paper towel for example, is arranged on the outer side of the footwear. The centrifugal forces exert a pressure on the water with which the footwear is filled, with the effect that water reaches the absorbent material if the footwear has a leak.

In such a waterproofness test, the footwear is first of all filled with water. In the case of footwear with outer material which does not have adequate inherent rigidity, rigid material is arranged in the space inside the upper for stabilizing it, in order to prevent the upper from collapsing during centrifuging. In the respective holding basket there is blotting paper or a paper towel, onto which the footwear to be tested is placed. The centrifuge is then made to rotate for a specific period of time. Thereafter, the centrifuge is stopped and the blotting paper or paper towel is examined to ascertain whether it is moist. If it is moist, the footwear tested has not passed the waterproofness test. If it is dry, the footwear tested has passed the test and is classified as waterproof.

The pressure which the water exerts during centrifuging depends on the effective shoe surface area (sole inner surface area), dependent on the shoe size, on the mass of the amount of water with which the footwear is filled, on the effective centrifuging radius and on the centrifuging speed.

Suitable materials for the waterproof, water-vapor permeable functional layer are, in particular, polyurethane, polypropylene and polyester, including polyether esters and their laminates, such as are described in the documents U.S. Pat. No. 4,725,418 and U.S. Pat. No. 4,493,870. Particularly preferred, however, is stretched microporous polytetrafluoroethylene (ePTFE), as is described for example in the documents U.S. Pat. No. 3,953,566 and U.S. Pat. No. 4,187,390, and stretched polytetrafluoroethylene provided with hydrophilic impregnating agents and/or hydrophilic layers; see, for example, the document U.S. Pat. No. 4,194,041. A microporous functional layer is understood to be a functional layer of which the average pore size lies between approximately 0.2 μm and approximately 0.3 μm.

The pore size can be measured with the Coulter Porometer (trade name), which is produced by Coulter Electronics, Inc., Hialeath, Fla., USA.

The Coulter Porometer is a measuring instrument which provides an automatic measurement of the pore size distributions in porous media, using the liquid displacement method (described in ASTM Standard E 1298-89).

The Coulter Porometer determines the pore size distribution of a sample by means of an increasing air pressure directed at the sample and by measuring the resultant flow. This pore size distribution is a measure of the degree of uniformity of the pores of the sample (i.e. a narrow pore size distribution means that there is little difference between the smallest pore size and the largest pore size). It is determined by dividing the maximum pore size by the minimum pore size.

The Coulter Porometer also calculates the pore size for the average flow. By definition, half the flow takes place through the porous sample through pores of which the pore size lies above or below this pore size for average flow.

If ePTFE is used as the functional layer, the reactive hot-melt adhesive can penetrate into the pores of this functional layer during the cementing operation, which leads to a mechanical anchoring of the reactive hot-melt adhesive in this functional layer. The functional layer consisting of ePTFE may be provided with a thin polyurethane layer on the side with which it comes into contact with the reactive hot-melt adhesive during the cementing operation. If PU reactive hot-melt adhesive is used in conjunction with such a functional layer, there occurs not only the mechanical bond but also a chemical bond between the PU reactive hot-melt adhesive and the PU layer on the functional layer. This leads to a particularly intimate adhesive bonding between the functional layer and the reactive hot-melt adhesive, so that particularly durable waterproofness is ensured.

Leather or textile fabrics are suitable for example as the outer material. The textile fabrics may be, for example, woven, knitted or nonwoven fabrics or felt. These textile fabrics may be produced from natural fibers, for example from cotton or viscose, from man-made fibers, for example from polyesters, polyamides, polypropylenes or polyolefins, or from blends of at least two such materials.

A lining material is normally arranged on the inner side of the functional layer. The same materials as are specified above for the outer material are suitable as lining material, which is often combined with the functional layer to form a functional layer laminate. The functional layer laminate may also have more than two layers, it being possible for a textile backing to be located on the side of the functional layer remote from the lining layer.

The outsole of footwear according to the invention may consist of waterproof material, such as for example rubber or plastic, for example polyurethane, or of non-waterproof, but breathable material, such as in particular leather or leather provided with rubber or plastic intarsias. In the case of non-waterproof outsole material, the outsole can be made waterproof, while maintaining breathability, by being provided with a waterproof, water-vapor-permeable functional layer at least at points at which the sole construction has not already been made waterproof by other measures.

The insole of footwear according to the invention may consist of viscose, for example a viscose which can be obtained under the trade name Texon, a nonwoven, for example polyester nonwoven, to which fusible fibers may be added, leather or adhesively bonded leather fibers. Insoles of such materials are water-permeable. Insoles of such material or other material can be made waterproof by arranging a layer of waterproof material on one of its surfaces or inside it. For this purpose, for example, a film with Kappenstoff V25 from the company Rhenoflex of Ludwigshafen, Germany, may be ironed on. If the insole is to be not only waterproof but also water-vapor-permeable, it is provided with a waterproof, water-vapor-permeable functional layer, which is preferably constructed with ePTFE (expanded, microporous polytetrafluoroethylene). An insole of leather finished in such a way can be obtained under the trade name TOP DRY from W.L. Gore & Associates GmbH, Putzbrunn, Germany.

BRIEF DESCRIPTION OF THE FIGURES

The invention as well as further aspects of the object and advantages are now explained in more detail on the basis of exemplary embodiments. In the drawings, partly in schematized cross-sectional representation, partly in perspective sectional representation:

FIGS. 22-25 show a thirteenth embodiment of the invention in a fourth production phase; and FIGS. 26-31 show a fourteenth embodiment of the invention in six different production phases.

DESCRIPTION OF EMBODIMENTS OF THE INVENTION

The terms vertical and horizontal are used here for describing the position of individual shoe components. This relates to the representations in the figures and corresponds to the idea that in most cases shoes are located with their outsole on a horizontal floor or other type of horizontal underlying surface.

Figure 1:
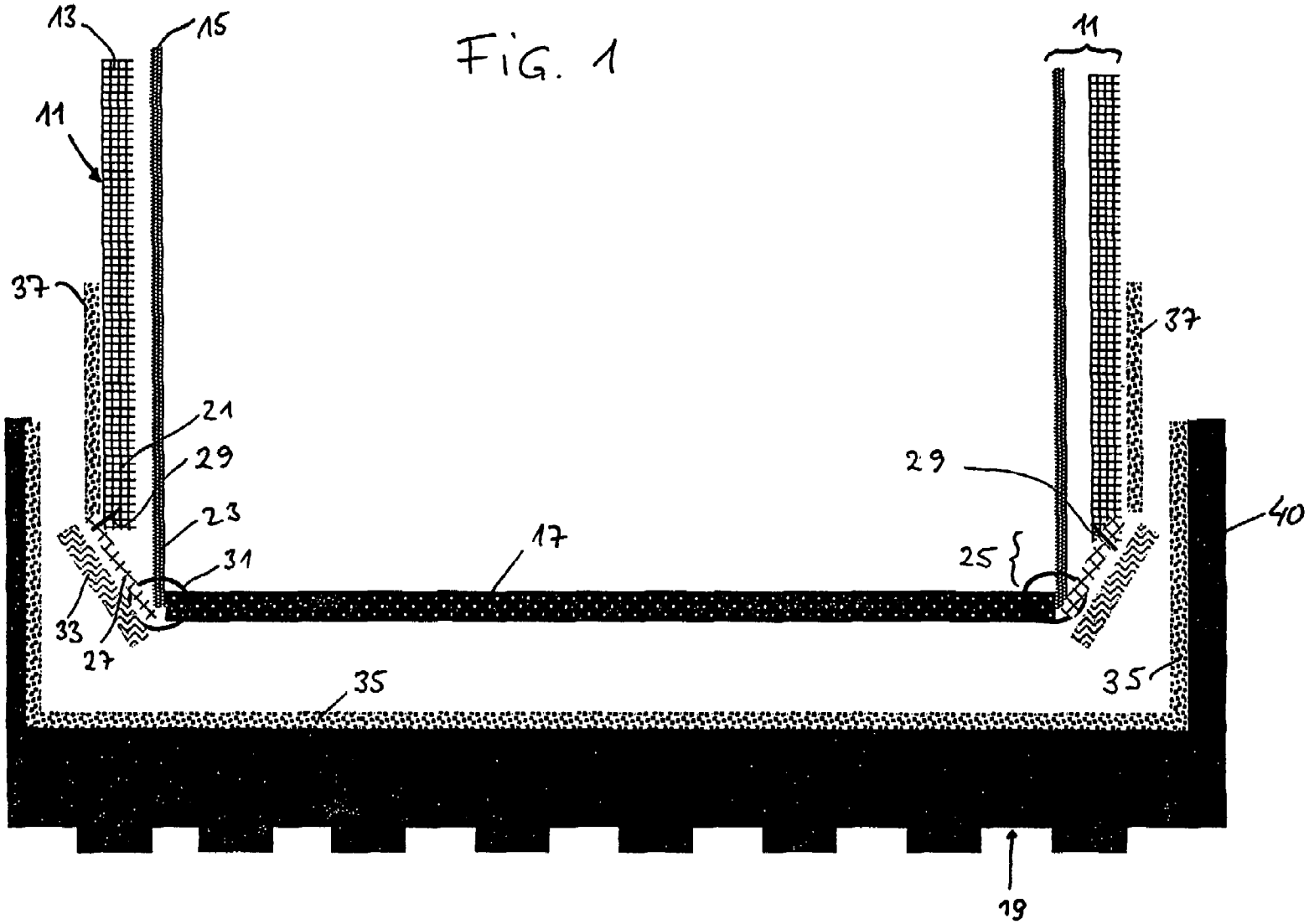
FIG. 1 shows in cross-sectional representation a first embodiment of a shoe according to the invention, with an insole, vertical upper end region and approximately vertical gauze strip.

FIG. 1 shows in a highly schematized cross-sectional representation a first embodiment of a shoe according to the invention, with an upper 11, which is constructed with an outer material 13 and a functional layer 15 lining the inner side of the latter. The functional layer 15 may be part of a functional-layer laminate, which has the functional layer and a lining layer on the inner side of the latter. Furthermore, the functional layer 15 may be provided with a textile backing (not represented) on its outer side facing the outer material 13. There are also embodiments in which the functional layer and the lining are separate layers of material.

Furthermore, FIG. 1 shows an insole 17 and a dish-like, prefabricated outsole 19, which is constructed with rubber and/or plastic. The outer material 13 and the functional layer 15 have an outer-material end region 21 or functional-layer end region 23 ending vertically, i.e. perpendicular to the tread of the outsole 19. The functional-layer end region 23 has an overhang 25 with respect to the outer-material end region 21. The overhang 25 is bridged by means of a gauze strip 27. A first, upper longitudinal side of the gauze strip is sewn by means of a first seam 29 to the lower end of the outer-material end region 21. A lower, second longitudinal side of the gauze strip 27 is sewn by means of a Strobel seam 31 both to the insole 17 and to the lower end of the functional-layer end region 23.

A reactive hot-melt adhesive 33, bringing about waterproofness when in the fully reacted state, is applied to the outer side of the gauze strip 27. In the liquid state, which the reactive hot-melt adhesive reaches for example by heating, the reactive hot-melt adhesive 33 penetrates through the gauze strip 27 and, in the region of the overhang 25, as far as the outer side of the functional layer 15. In the fully reacted state, the reactive hot-melt adhesive 33 then seals this region of the functional layer 15 with a waterproof effect. The reactive hot-melt adhesive 33 is preferably applied over such an extent and in such an amount that it also seals the cut edge of the functional layer 15 at the lower end of the functional-layer end region 23. It is preferred in this case for the sealing to include the peripheral region of the insole 17 adjacent to the functional-layer end region 23 and the fastening seams involving the functional layer 15.

Water or other liquid which has penetrated along the water- or liquid-conducting outer material 13 to the lower end of the outer-material end region 21 cannot reach the inner side of the functional layer 15, and consequently cannot reach the inner lining of the shoe, on account of this sealing by means of reactive hot-melt adhesive 33.

Outsole cement 35, which may be conventional outsole cement, to be precise in the form of solvent adhesive or hot-melt adhesive, is applied over preferably the entire inner side of the outsole 19. Furthermore, outsole cement 37 is applied to the outer side of the outer material 13. Shown in FIG. 1 is a state of production of the shoe of the first embodiment before the outsole 19 is pressed upwards against the insole 17 in order to bond it adhesively to the insole 17 and the upper end region on the sole side. In this case, the outsole cement 35 on the inner side of the upturned edge 40 of the outsole 19 enters into an adhesive bond with the outsole cement 37 applied to the upper end region.

For better representation and overall clarity, in FIG. 1 and further figures the distances between the individual components of the shoe construction are shown larger than they actually are. In fact, the distances between the individual components are dimensioned in such a way that, after the outsole 19 has been pressed onto the insole 17, the upturned edge 40 bears right up against the outer side of the outer material 13 and is adhesively bonded to the outer material 13.

Figure 2:
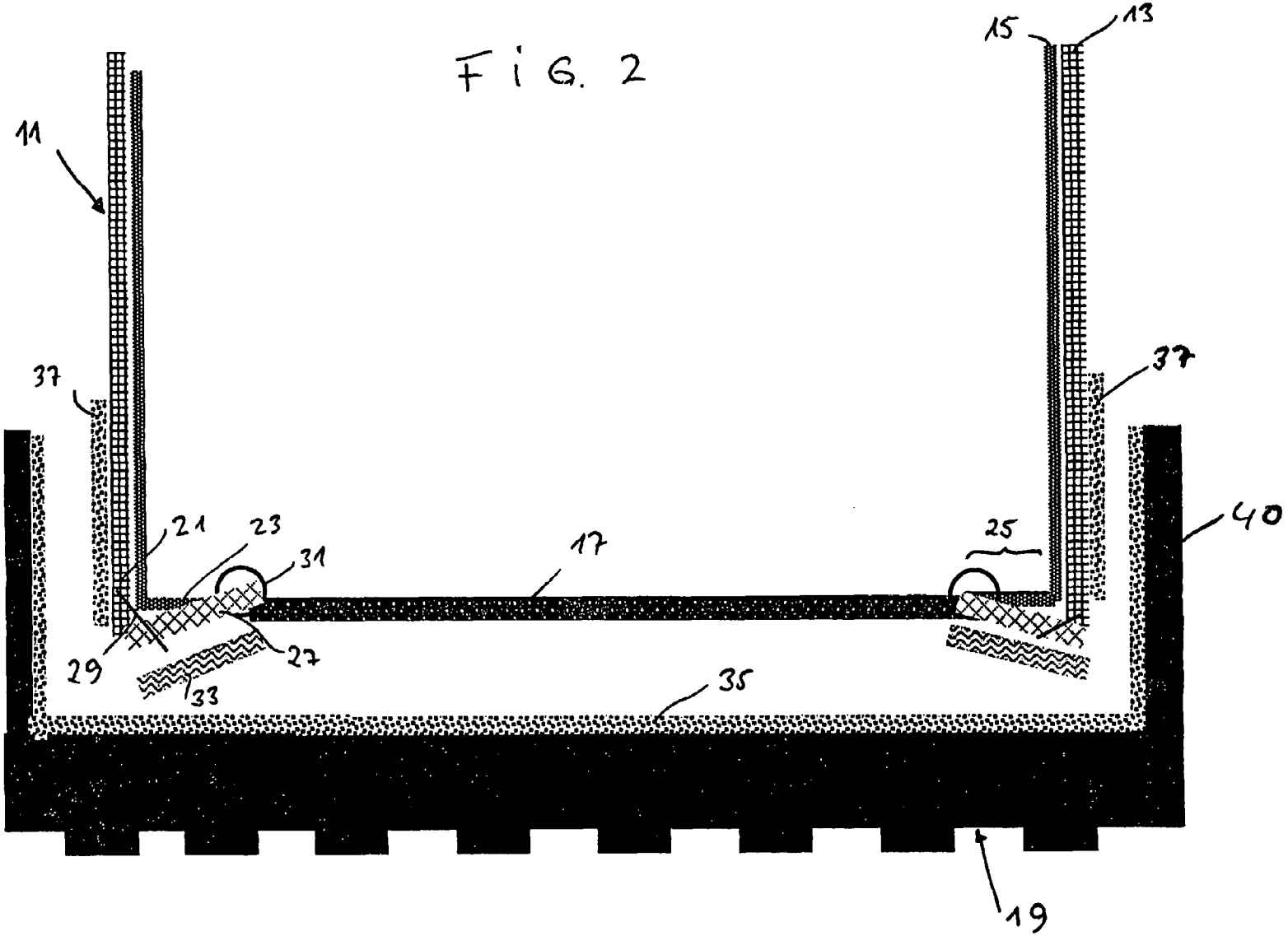
FIG. 2 shows in cross-sectional representation a second embodiment of a shoe according to the invention, with an insole, vertical outer-material end region, horizontal functional-layer end region and approximately horizontal gauze strip.

FIG. 2 shows a second embodiment of a shoe according to the invention, which largely coincides with the first embodiment shown in FIG. 1, but differs from the first embodiment to the extent that in the second embodiment only the outer-material end region 21 ends vertically, while the functional-layer end region 23 ends horizontally, i.e. parallel to the tread of the outsole 19. Therefore, the overhang 25 of the functional-layer end region 23 and essentially also the gauze strip 27 and the reactive hot-melt adhesive 33 also run horizontally. On account of the horizontal extent of the functional-layer end region 23, the insole 17 does not extend over the entire width of the sole of the shoe construction but instead its peripheral edge is at a distance from the vertical part of the upper 11. Otherwise, it coincides with the first embodiment, so that, with regard to further aspects of the second embodiment, reference is made to the remarks made above concerning the first embodiment.

Figure 3:
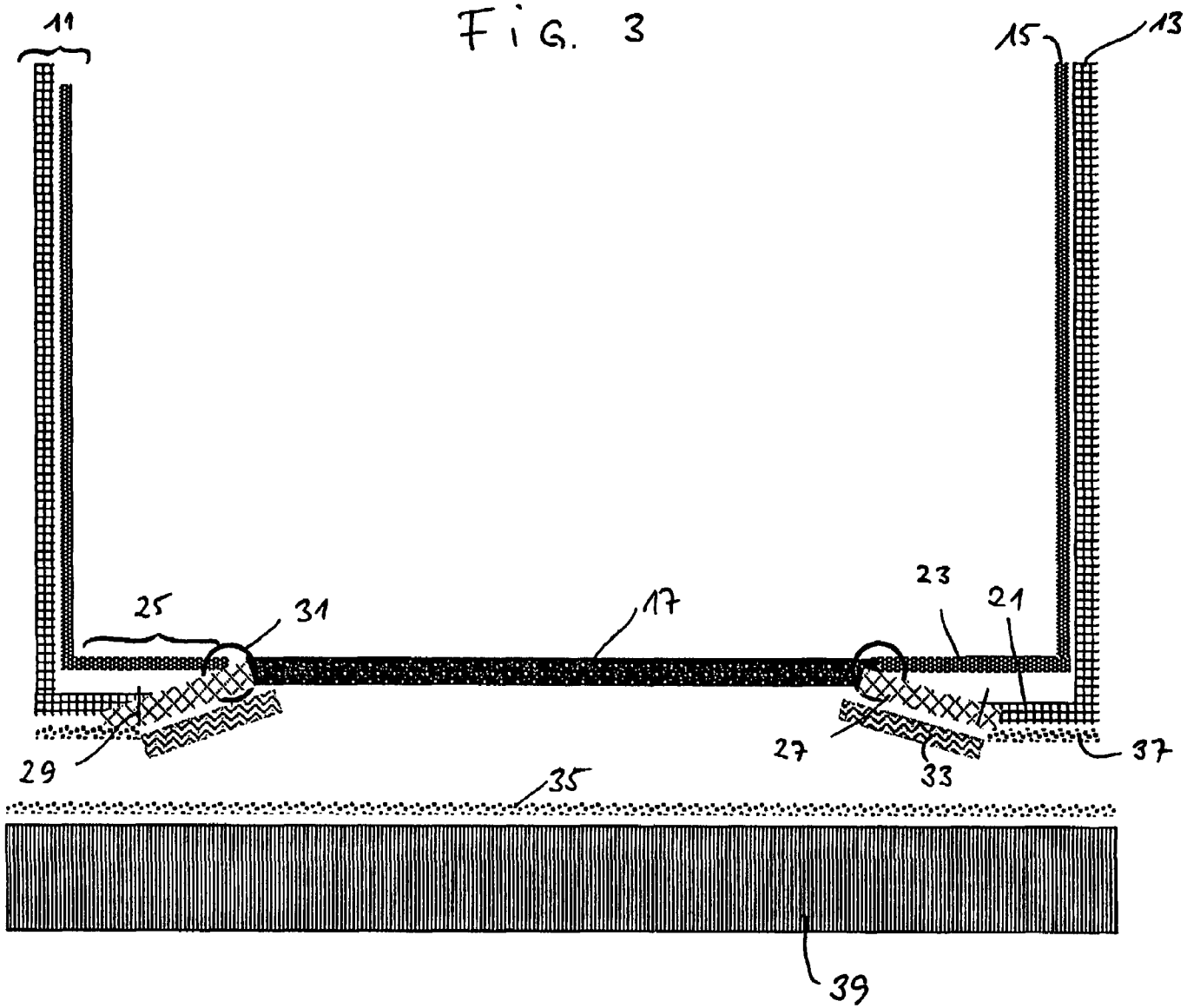
FIG. 3 shows in cross-sectional representation a third embodiment of a shoe according to the invention, with an insole, horizontal upper end region and approximately horizontal gauze strip.

FIG. 3 shows a third embodiment of a shoe according to the invention, in which both the outer-material end region 21 and the functional-layer end region 23 run horizontally, which leads to an approximately horizontal extent of the gauze strip 27 and the reactive hot-melt adhesive 33 in this embodiment as well. Such a shoe construction allows the use of a sheet-like outsole 39, since a vertical end region of the upper 19 does not have to be enclosed by means of an upturned edge of a dish-like outsole as in the case of the first and second embodiments. For this reason, any outsole may be used for the third embodiment, for example a leather sole as desired for shoes of an elegant type. On account of the exclusively horizontal extent of the outsole 39, the outsole cement 37 applied to the outer side of the outer material 13 is applied to the horizontally running outer-material end region 21.

Figure 4:
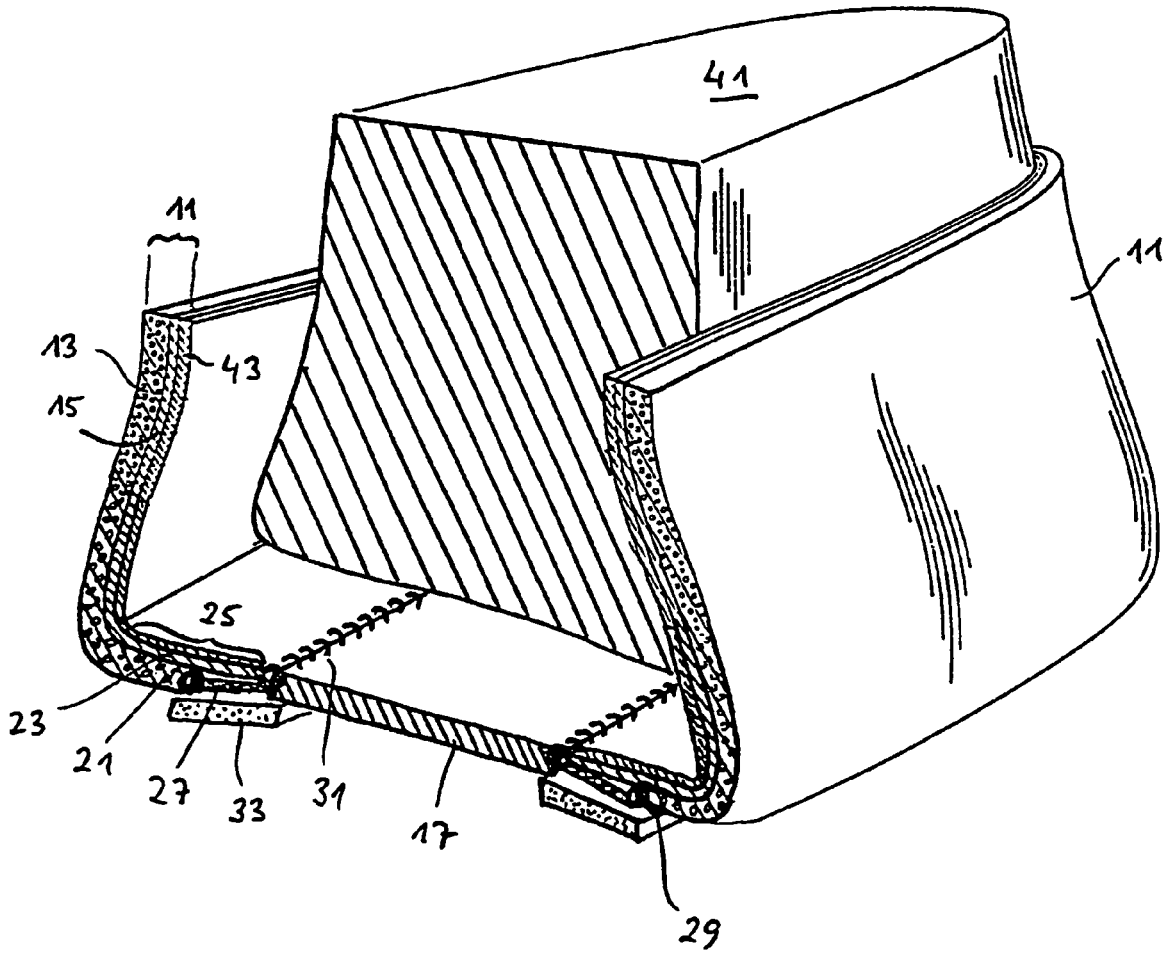
FIG. 4 shows a perspective sectional representation of the third embodiment still without an outsole.

The third embodiment, shown in FIG. 3, is shown in FIG. 4 in a partially sectioned perspective representation, but still without an outsole. This figure shows a last 41, over which the upper 11 has been pulled. As a departure from FIG. 3, in FIG. 4 a separate lining layer 43 is shown on the inner side of the functional layer 15. FIG. 4 shows the shoe construction in a state in which the reactive hot-melt adhesive has been applied only to the underside of the gauze strip 27, but has not yet been pushed through the gauze strip 27 to penetrate as far as the functional-layer end region 23.

Figure 5:
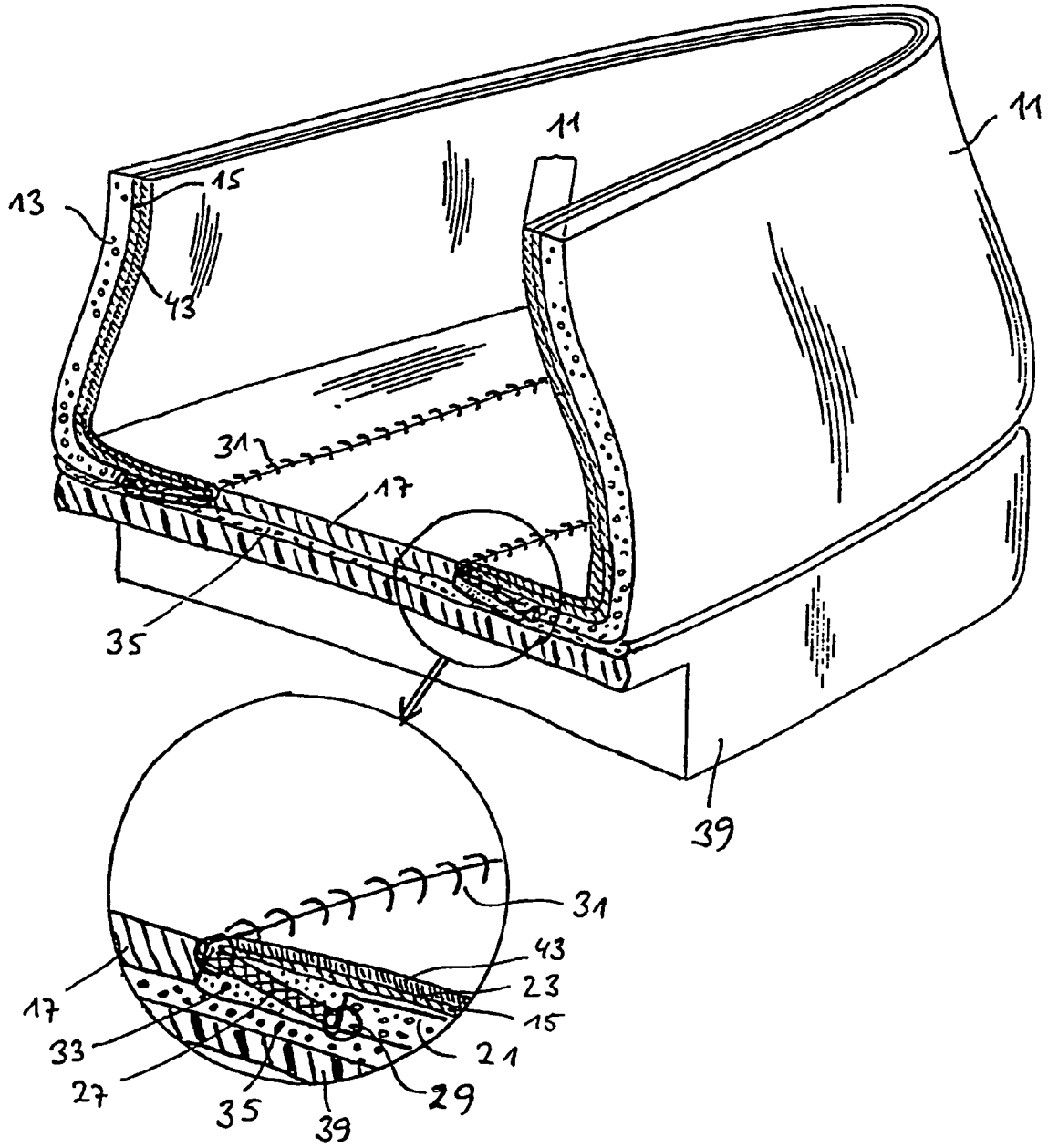
FIG. 5 shows a representation as in FIG. 4, but with an outsole.

FIG. 5 shows a shoe construction according to FIG. 4, likewise in a partially sectioned perspective representation, after the adhesive attachment of an outsole 39 to the underside of the insole 17 and to the underside of the vertical region of the upper 11. In this representation, the last 41 has already been removed from the shoe.

For better illustration, a circular detail of the sole construction is additionally shown in enlargement. This reveals that, in this stage of production, the reactive hot-melt adhesive 33 has already penetrated as far as the functional layer 15.

Figure 6:
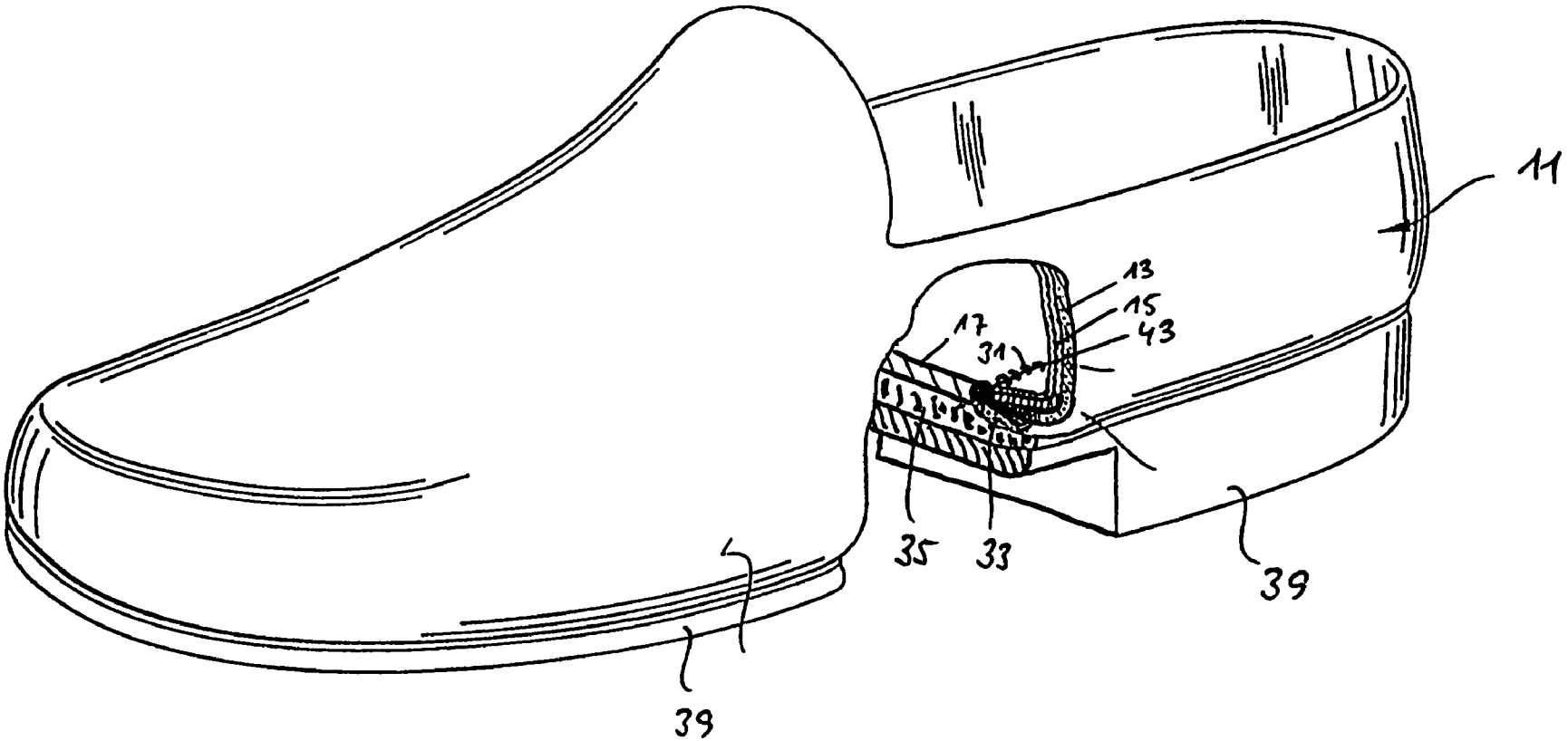
FIG. 6 shows a partially sectioned perspective representation of an entire shoe according to the third embodiment.

FIG. 6 shows in a perspective representation an entire shoe of the third embodiment, represented in FIG. 5, part of the shoe having been cut open in order to illustrate at which point of the shoe the cut according to FIG. 5 is located.

Figure 7:
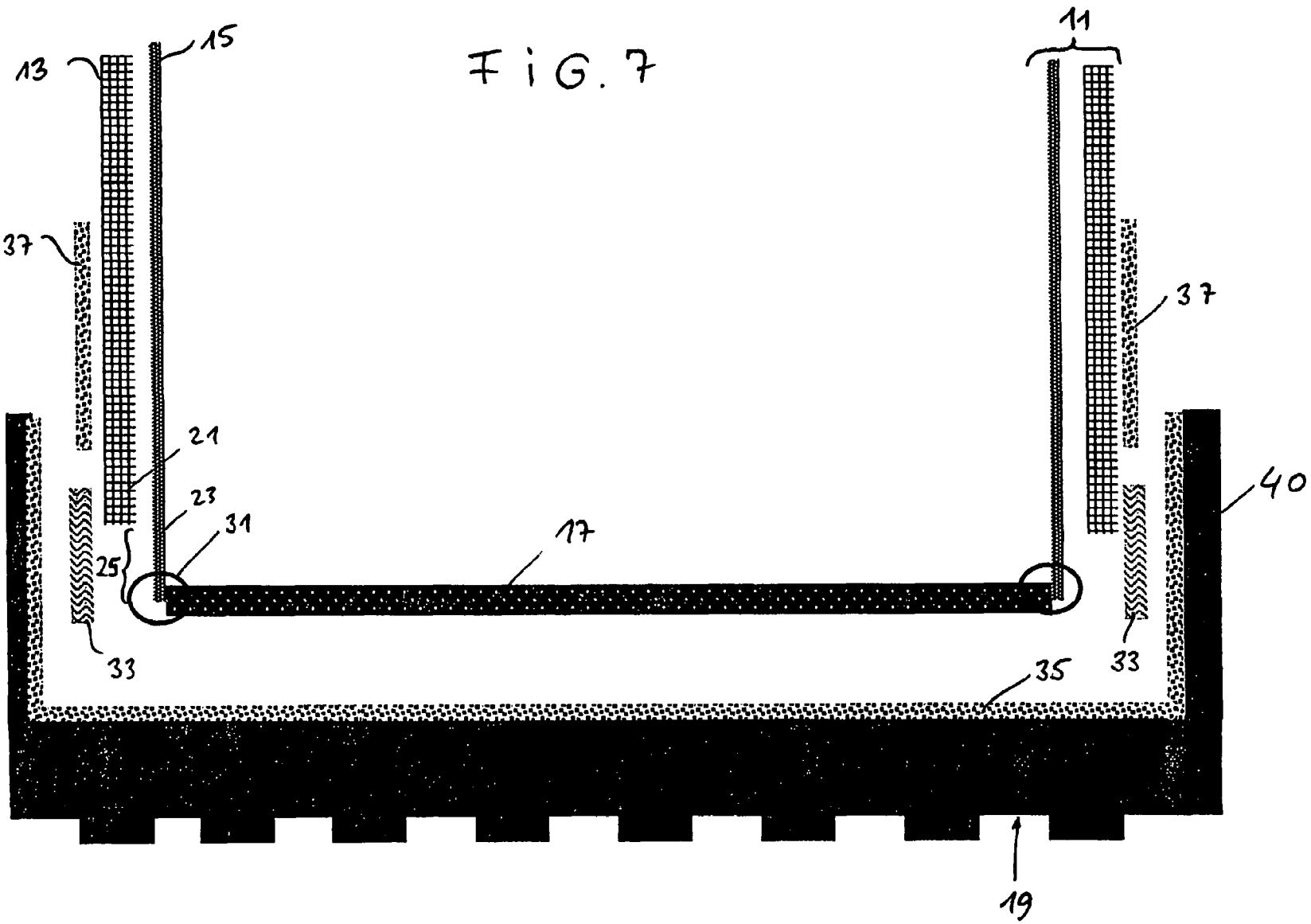
FIG. 7 shows a fourth embodiment of a shoe according to the invention, with a construction as in the first embodiment, but without a gauze strip.

FIG. 7 shows a fourth embodiment of a shoe according to the invention, which coincides with the first embodiment, shown in FIG. 1, with the exception that in the fourth embodiment no gauze strip 27 is present. Therefore, reference can to a great extent be made to the preceding description concerning the first embodiment.

In the fourth embodiment there is no connection between the lower end of the outer-material end region 21 and the lower end of the functional-layer end region 23 and the insole 17 before the adhesive attachment of the outsole 19 and before adhesive bonding with the reactive hot-melt adhesive 33 in the upper end region. Only after application of the reactive hot-melt adhesive 33 is there a connection between the outer-material end region 21 and the functional-layer end region 23 on account of the adhesive effect of the said adhesive, if the reactive hot-melt adhesive is applied to such an extent that it includes the lower edge of the outer-material end region, which is not absolutely necessary. After the adhesive attachment of the outsole 19 to the insole 17 and the upper 11, the outer-material end region 21 is also laterally fixed by means of the upturned edge 40 of the outsole 19.

Figure 8:
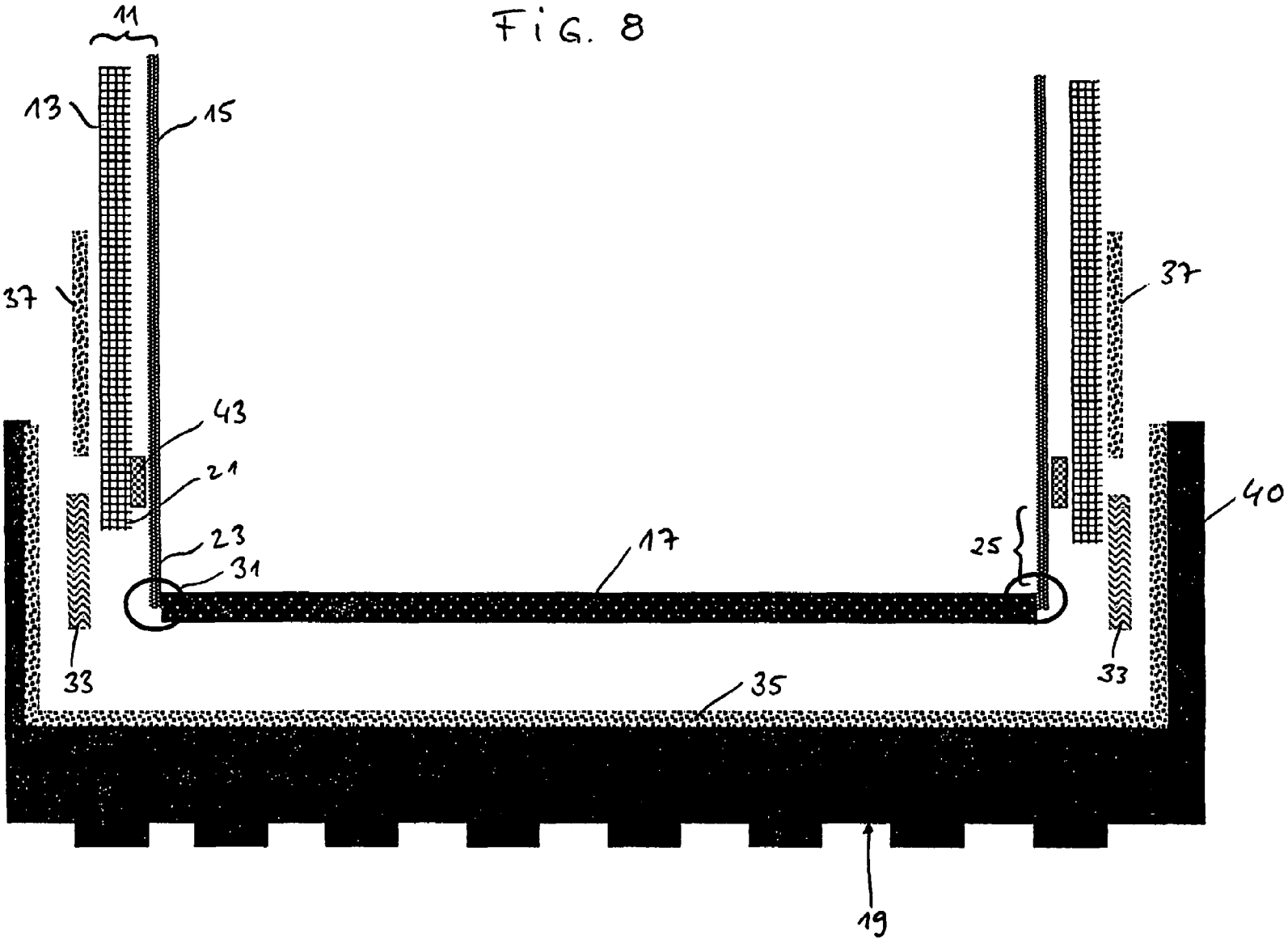
FIG. 8 shows a fifth embodiment of a shoe according to the invention, which coincides with the fourth embodiment but additionally has a fixing adhesive bond between the outer-material end region and the functional layer.

The fifth embodiment, shown in FIG. 8, coincides with the fourth embodiment, shown in FIG. 7, with the only exception that the outer-material end region 21 is fixed by means of fixing adhesive 43 to the outer side of the functional layer 15. This serves for easier handling of the upper 11 during production steps before the adhesive attachment of the outsole 19.

Figure 9:
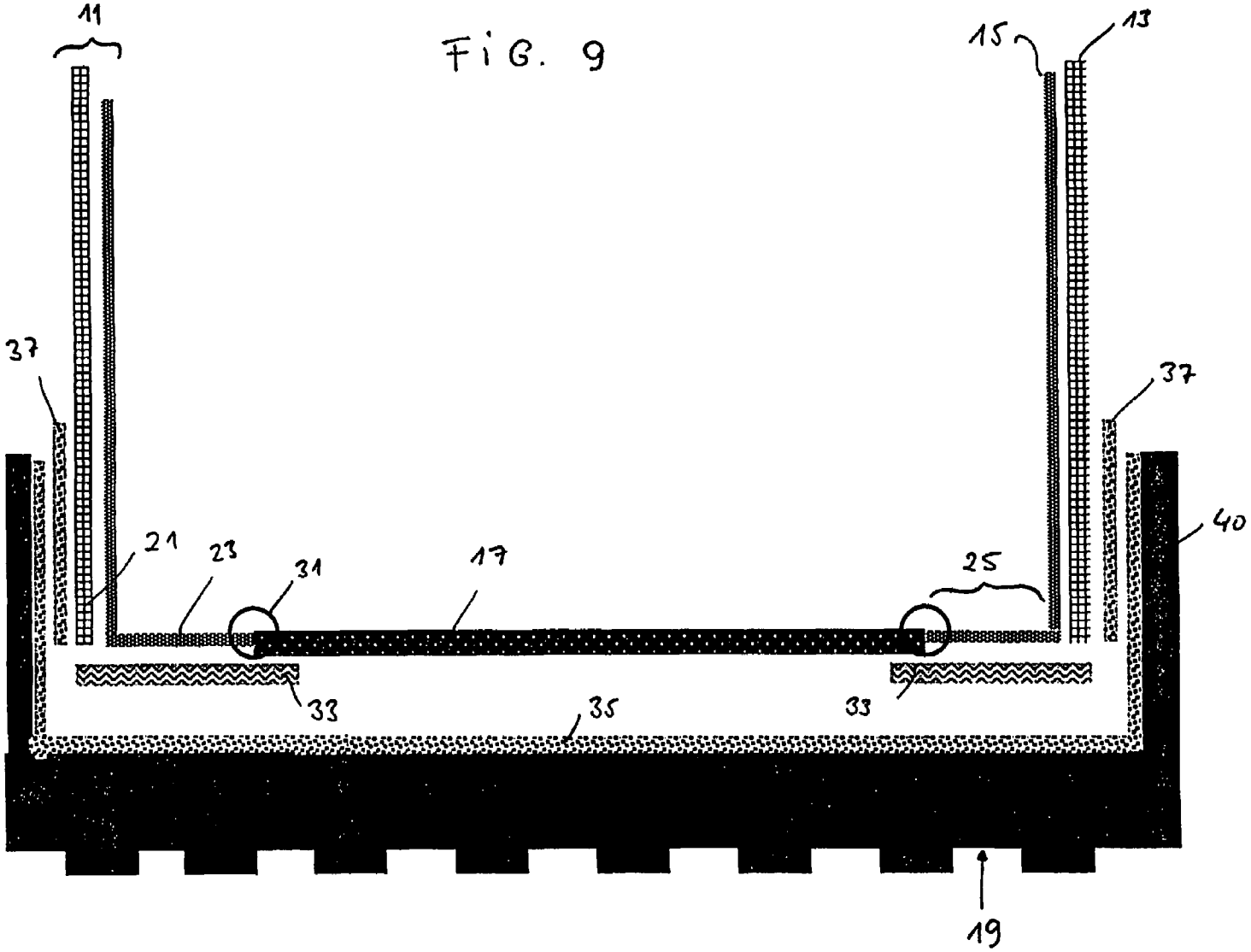
FIG. 9 shows a sixth embodiment of a shoe according to the invention, with a construction as in the second embodiment but without a gauze strip.

The sixth embodiment of the invention, shown in FIG. 9, shows a shoe construction which coincides with the second embodiment according to FIG. 2, with the exception that no gauze strip is present. With regard to the aspects coinciding with the second embodiment, reference can be made to the explanations concerning FIG. 2. As in the case of the fourth embodiment, shown in FIG. 7, the reactive hot-melt adhesive 33 in the sixth embodiment is also applied directly to the outer side of the overhang 25 of the functional-layer end region 23, which leads to particularly good adhesive bonding, with a sealing effect, of the functional-layer end region 23 by the reactive hot-melt adhesive 33.

In a way corresponding to the fourth embodiment in FIG. 7, no cementing between the outer-material end region 21 and the outer side of the functional layer 15 is provided in the sixth embodiment in FIG. 9 either. The outer-material end region 21 therefore lies only loosely on the outer side of the functional layer 15 before the outsole 19 is adhesively bonded by means of the reactive hot-melt adhesive 33 or before it is adhesively attached.

Figure 10:
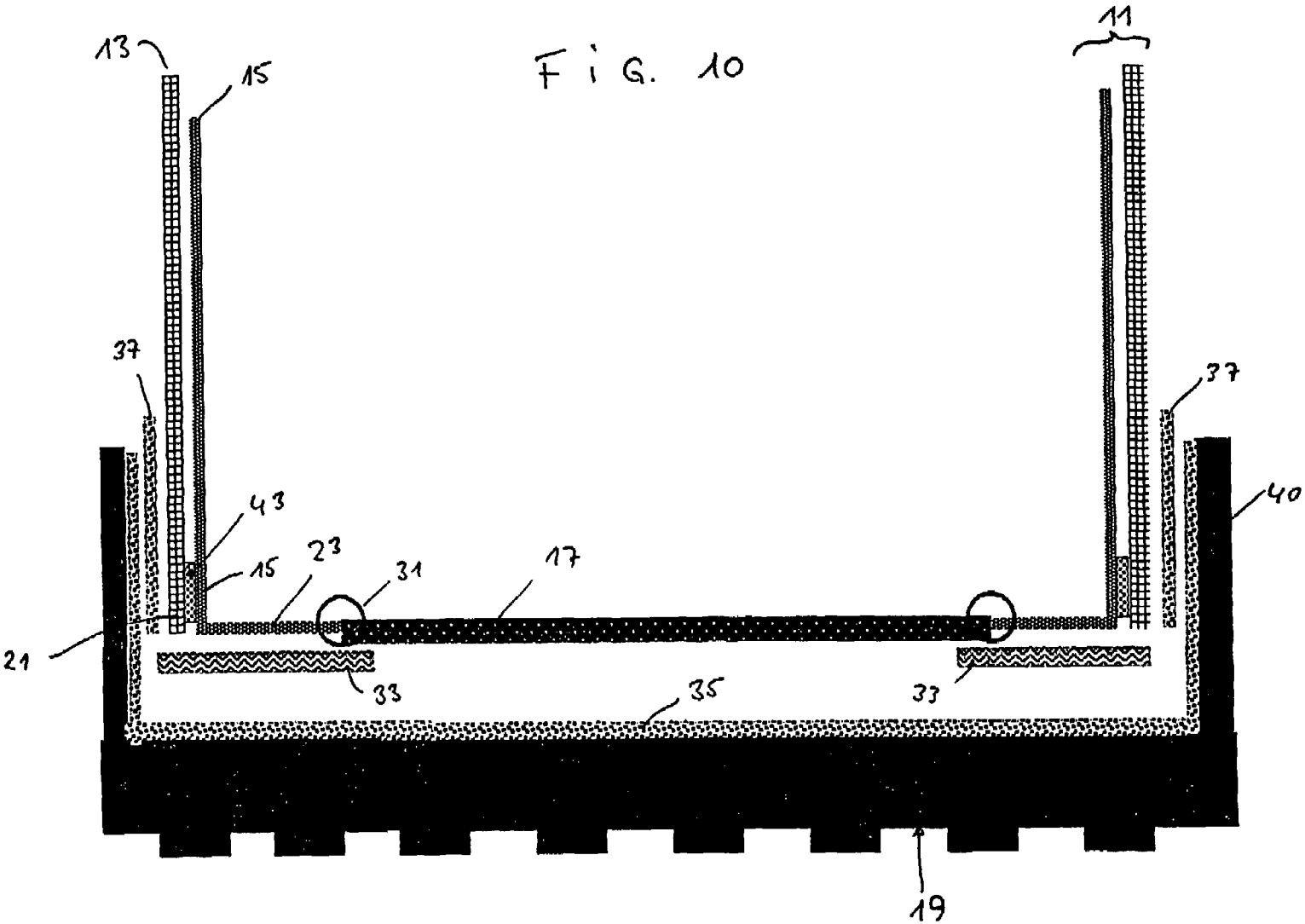
FIG. 10 shows a seventh embodiment of a shoe according to the invention, which coincides with the sixth embodiment but additionally has a fixing adhesive bond between the outer-material end region and the functional layer.

FIG. 10 shows a seventh embodiment, which represents a modification of the sixth embodiment, shown in FIG. 9, to the extent that the outer-material end region 21 is fixed by means of fixing adhesive 43 to the outer side of the lower end of the vertical region of the functional layer 15 before the further production steps are carried out, namely sewing the functional-layer end region 23 to the insole 17, applying the reactive hot-melt adhesive 33 and adhesively attaching the outsole 19. Otherwise, with regard to the seventh embodiment, reference can be made to preceding explanations concerning preceding figures.

Figure 11:
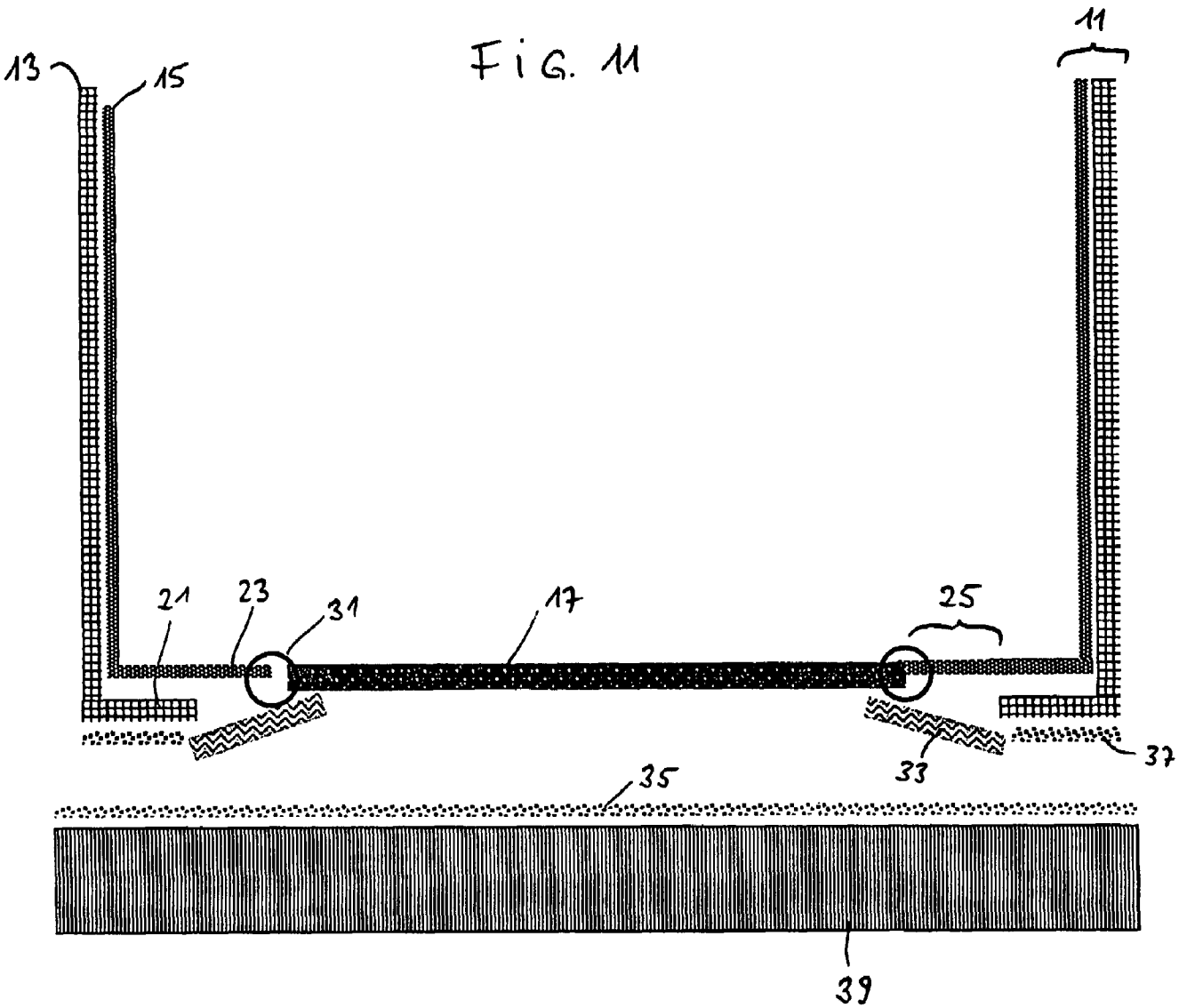
FIG. 11 shows an eighth embodiment of a shoe according to the invention, with a construction as in the third embodiment but without a gauze strip.

The eighth embodiment of the invention, shown in FIG. 11, coincides with the third embodiment, shown in FIG. 3, with the exception that no gauze strip is present. Therefore, reference can be made to a great extent to the preceding explanations concerning FIG. 3. In the eighth embodiment too, the reactive hot-melt adhesive 33 is applied directly to the outer side of the overhang 25 of the functional-layer end region 23, as far as possible to such an extent that the end of the horizontal outer-material end region 21, the peripheral edge of the insole 17 and the Strobel seam 31 are also included in the sealing by the reactive hot-melt adhesive 33. In this embodiment, there is no fixing adhesive bonding between the functional layer 15 and the outer-material end region 21.

Figure 12:
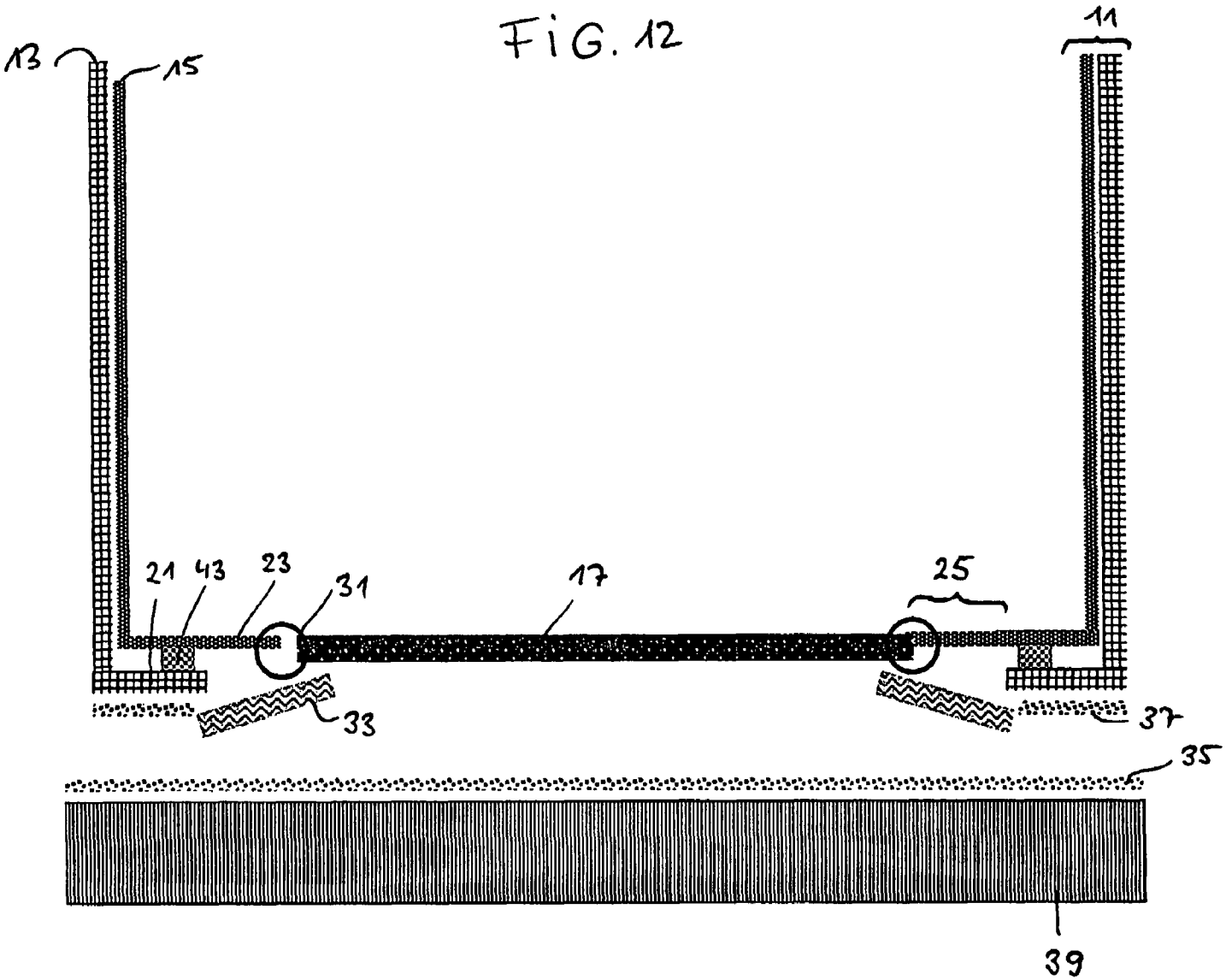
FIG. 12 shows a ninth embodiment of a shoe according to the invention, which coincides with the eighth embodiment but additionally has a fixing adhesive bond between the outer-material end region and the functional layer.

The ninth embodiment, shown in FIG. 12, coincides with the eighth embodiment, shown in FIG. 11, with the exception that the outer-material end region 21 is fixed to the outer side of the functional-layer end region 23 by means of a fixing adhesive bonding 43.

Figure 13:
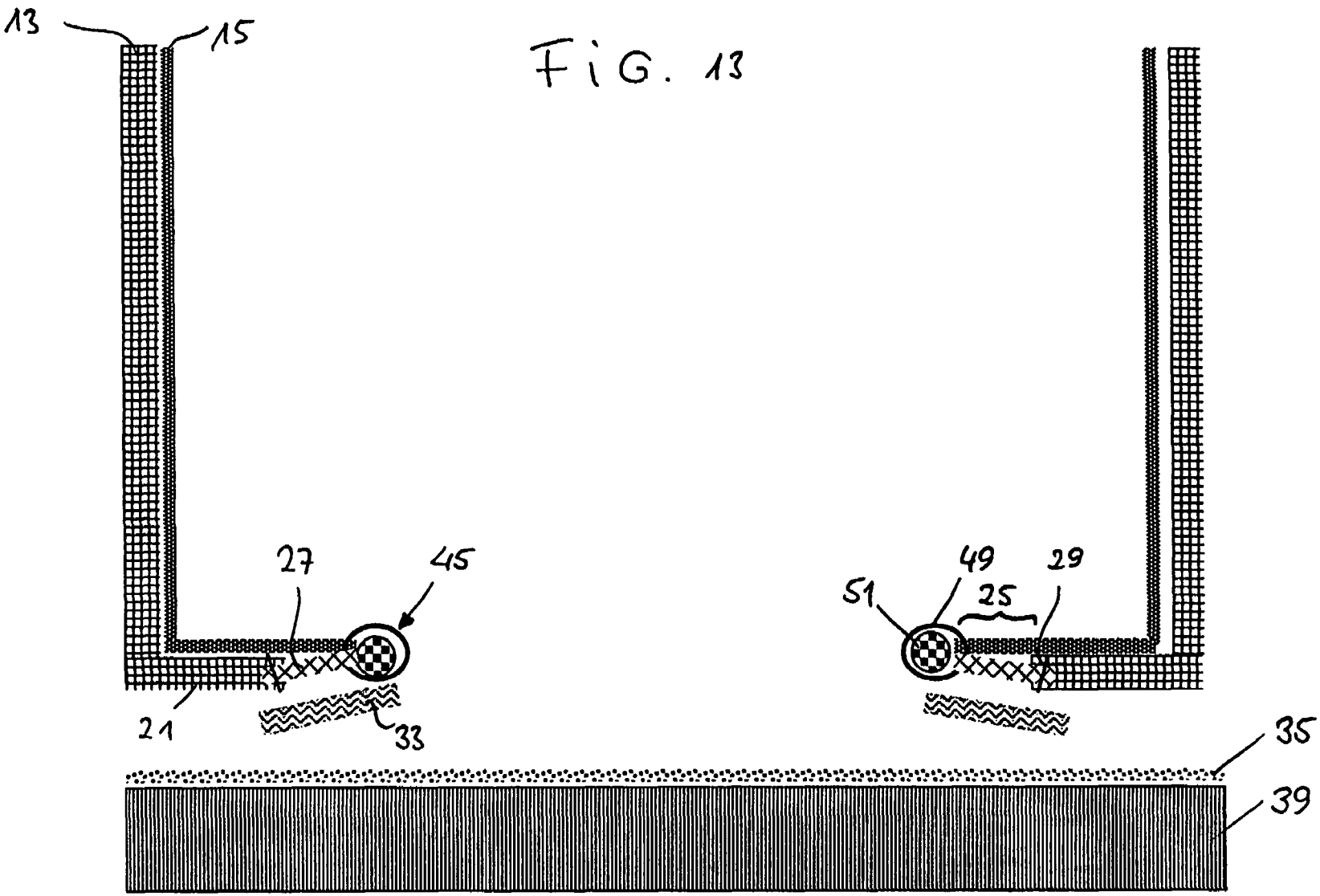
FIG. 13 shows a tenth embodiment of a shoe according to the invention, without an insole, in which the functional-layer end region is tensioned in horizontal alignment by a string-lasting, with a gauze strip.

FIG. 13 shows as the tenth embodiment of the invention a shoe without an insole or without an insole in the region represented of the shoe. There are shoes which are constructed without an insole over part of their shoe length, for example in the front-foot region, and with an insole in the remaining part of the shoe.

Since the shoe or part of a shoe shown in FIG. 13 has no insole, the components of the vertical region of the upper, namely the horizontal outer-material end region 21 and the horizontal functional-layer end region 23, must be kept in their horizontal position in some other way. Used for this purpose is what is known by those skilled in the art as string-lasting 45, by means of which the functional-layer end region 23 is lashed together. The string-lasting 45 has a loop-like string tunnel 49, which runs around the entire inner periphery of the functional-layer end region 23 in which there is a string 51 by means of which the functional-layer end region 21 can be lashed together while the upper is stretched over a last (not shown in FIG. 13).

In this embodiment, a gauze strip 27 is sewn on one longitudinal side to the outer-material end region 21 and on the other longitudinal side to the string tunnel 49 of the string-lasting 45, so that the overhang 25 of the functional-layer end region 23 is bridged by the gauze strip 27 and the outer-material end region 21 is kept horizontal. Reactive hot-melt adhesive 33, which leads to waterproof sealing of the functional layer 15 in the region of the functional-layer end region 23 when in a fully reacted state, is applied to the underside of the gauze strip 27. The reactive hot-melt adhesive 33 is in this case dimensioned as far as possible in such a way that it also includes in its sealing the string-lasting 45 and/or the seam 29 between the gauze strip 27 and the outer-material end region 31.

After applying reactive hot-melt adhesive 33, a sheet-like outsole 39 is adhesively attached to the underside of the horizontal region of the upper by means of outsole cement 37. Although not represented in FIG. 13, outsole cement may be applied to the underside of the outer-material end region 21 before the outsole 39 is adhesively attached in this embodiment as well.

Figure 14:
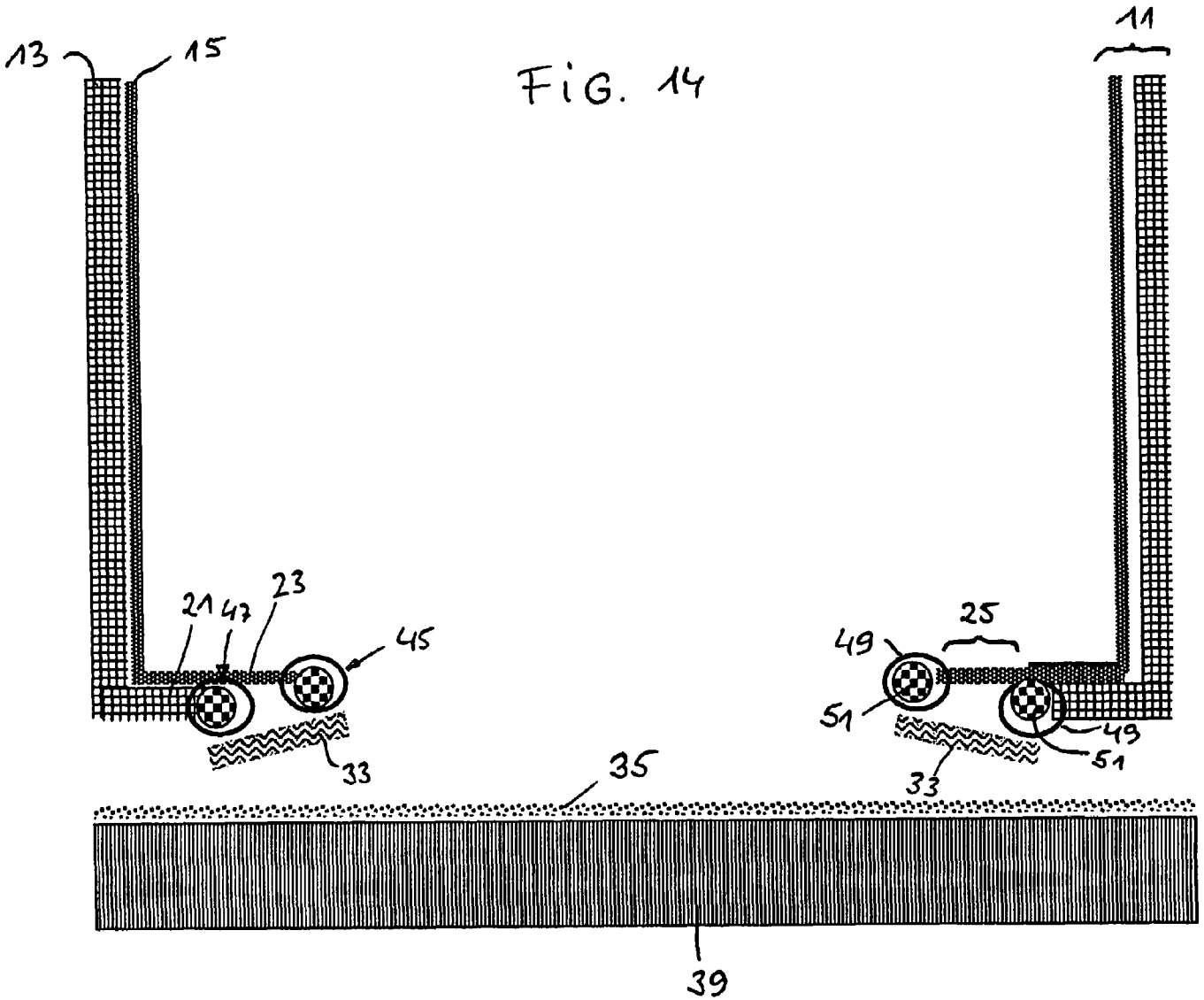
FIG. 14 shows an eleventh embodiment of a shoe according to the invention, with a construction as in the tenth embodiment but without a gauze strip and with a second string-lasting.

FIG. 14 shows an eleventh embodiment, which coincides with the tenth embodiment, shown in FIG. 13, with the exception that it has no gauze strip, but instead a second string-lasting 47, by means of which the outer-material end region 21 is lashed together in a horizontal position. In this embodiment, the reactive hot-melt adhesive 33 is applied directly to the outer side of the overhang 25 of the functional-layer end region 21.

The second string-lasting 47 has a tubular string tunnel 49, which runs around the entire inner periphery of the outer-material end region 21 and in which there is a string 51 by means of which the outer-material end region 21 can be lashed together while the upper is stretched over a last (not shown in FIG. 13).

The reactive hot-melt adhesive 33 is in this case dimensioned as far as possible in such a way that it also includes in its sealing the string-lastings 45 and 47.

Figure 15:
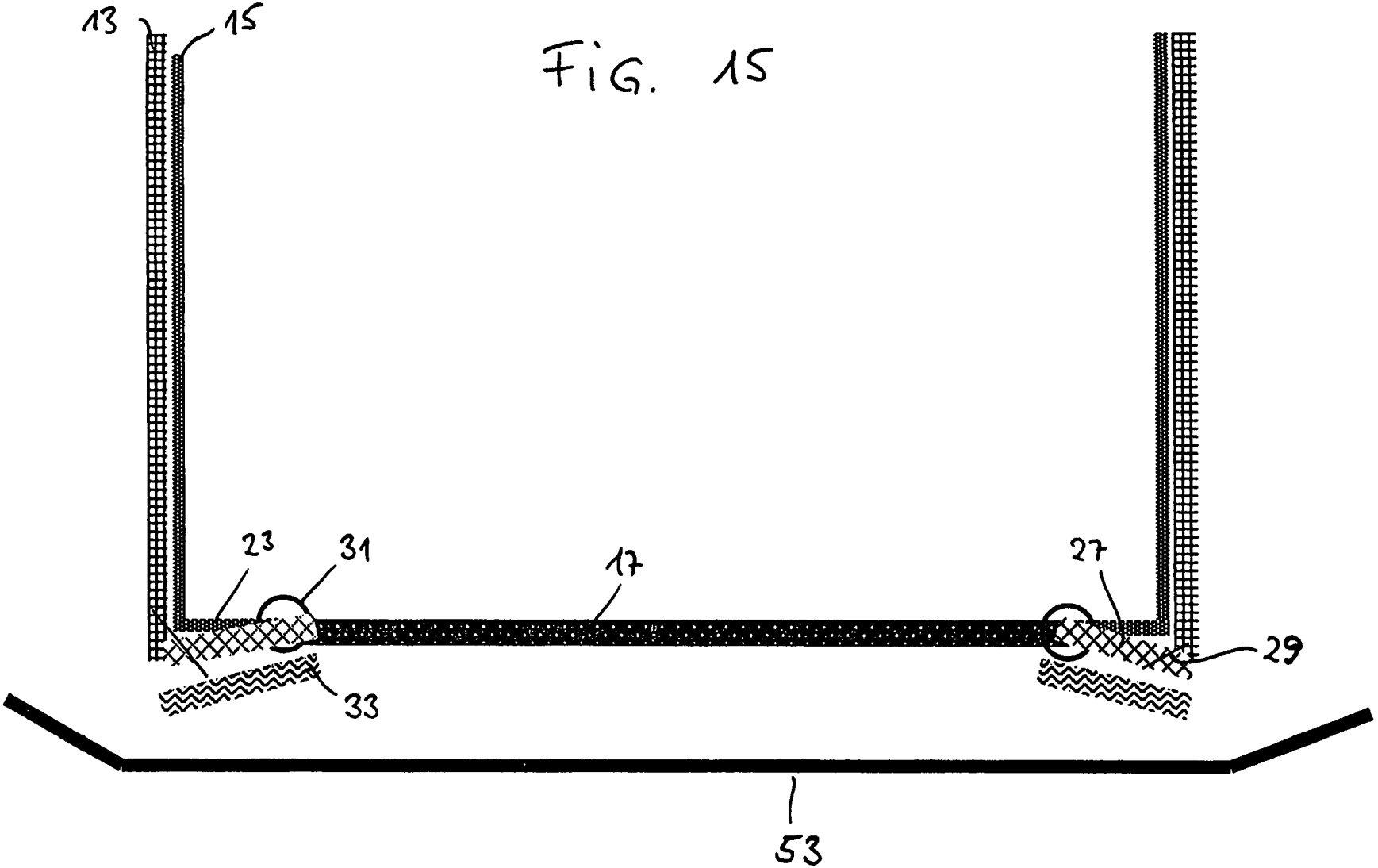
FIG. 15 shows the second embodiment of the invention, but still without an outsole, with a pressing device for pressing the previously applied reactive hot-melt adhesive.

In FIG. 15, a production aid, namely pressing device 53, by means of which the reactive hot-melt adhesive 33 can be pressed in the liquid or liquefied state against the outer side of the functional-layer end region 21, is also illustrated in a highly schematized representation. Although this is represented in FIG. 15 for a shoe construction according to the second embodiment, shown in FIG. 2, it can likewise be used for all of the other embodiments described.

Once the reactive hot-melt adhesive 33 has been applied and possibly brought into a liquid state by activation, it is pressed by means of the pressing device 53 in the direction of the functional-layer end region 23, in order to ensure a particularly intimate adhesive bonding of the reactive hot-melt adhesive 33 with the outer side of the functional layer 15 in the functional-layer end region 23, which is to be preferred in particular in shoe embodiments with a gauze strip in order to ensure that sufficient reactive hot-melt adhesive 33 penetrates as far as the surface of the functional layer 15.

The pressing device 53 may be in the form of a flat dish of the form shown in FIG. 15 or of some other form than that represented in FIG. 15, which may depend on the form of the respective shoe construction. The pressing device 53 may also be designed as a pressing pad, for example in the form of a rubber pad or an air cushion, i.e. a cushion filled with air. At least the surface of the pressing device 53 which comes into contact with the reactive hot-melt adhesive 33 during the pressing operation is made of a material which cannot be wetted by the reactive hot-melt adhesive 33, and consequently does not bond with the latter. Particularly suitable is a pressing device 53 with a surface of polytetrafluoroethylene (also known by the trade name Teflon), which has a smooth surface and not a porous surface like expanded, microporous tetrafluoroethylene, suitable for the functional layer. In this case, the surface of the pressing device 53 itself consists of such material or a film of such material is introduced between the sole construction of the footwear and the pressing device 53 before the pressing operation.

Figure 16:
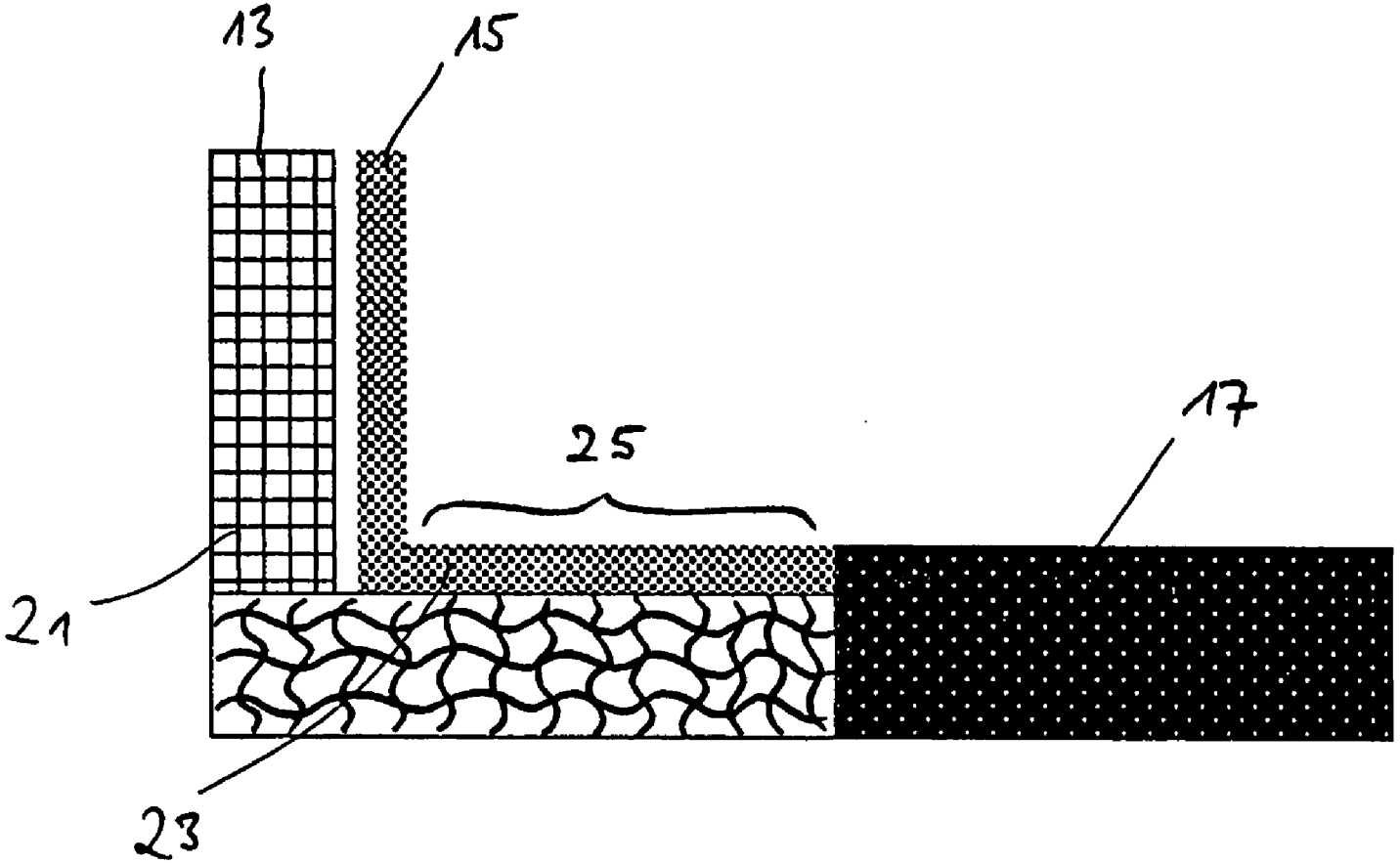
FIG. 16 shows in a schematized, not-to-scale, greatly enlarged, two-dimensional representation a detail of a sole construction with reactive hot-melt adhesive fully reacted by three-dimensional crosslinking of molecule chains.

FIG. 16 shows in a schematized, not-to-scale, greatly enlarged, two-dimensional representation a detail of a sole construction with reactive hot-melt adhesive 33 fully reacted by three-dimensional crosslinking of molecule chains (the seam 31 joining the functional-layer end region 23 and the insole 17 not being represented). The three-dimensionality of the crosslinking is created by the molecule chains of the reactive hot-melt adhesive 33 crosslinking also in the third dimension (perpendicular to the surface of the drawing), not visible in FIG. 16, in the way represented for two dimensions. The three-dimensional crosslinking provides particularly strong protection against the penetration of water into the adhesive.

Figure 20:
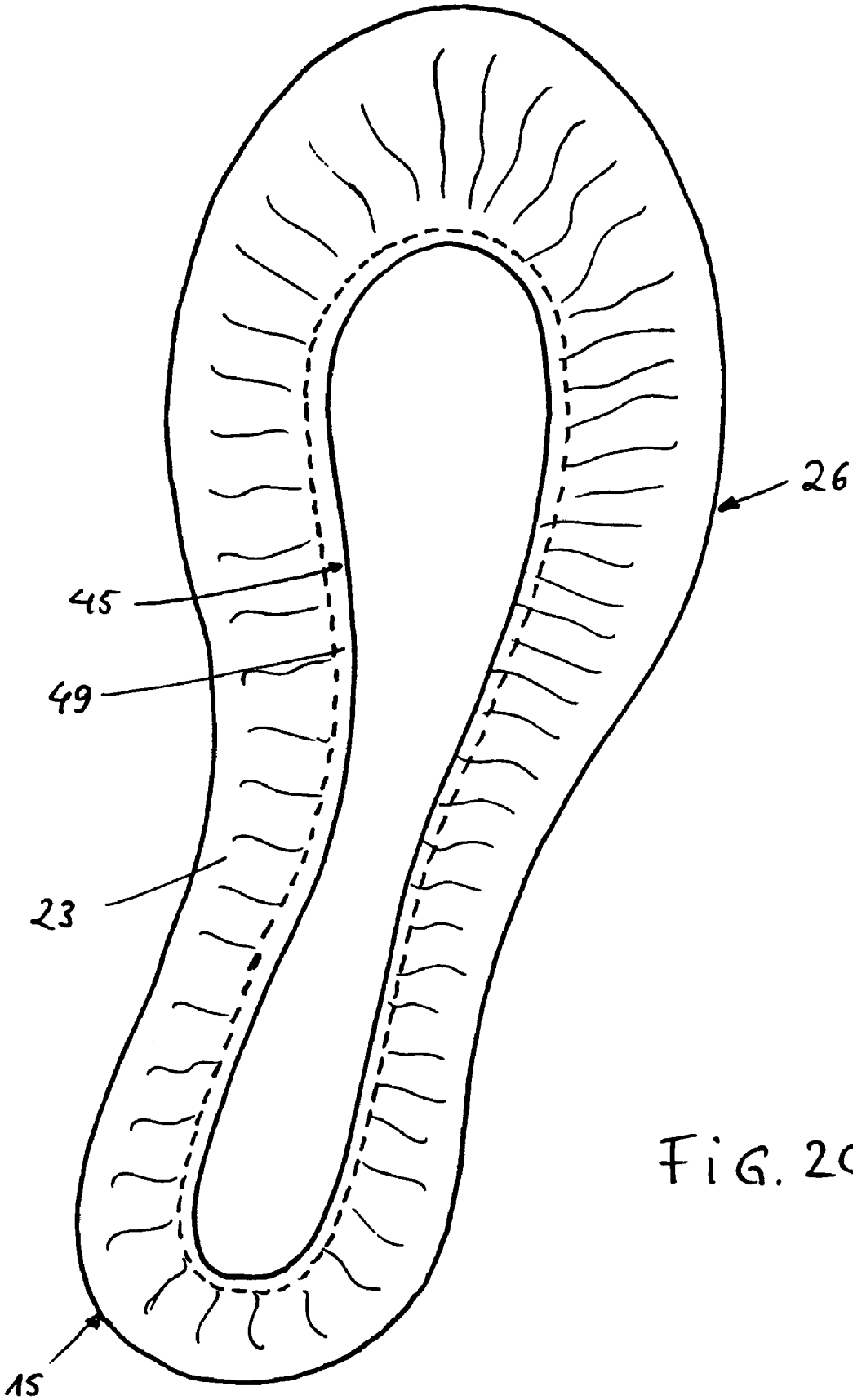
FIG. 20 shows a plan view from below of a functional layer part with an elastic string-lasting at a functional-layer end region on the sole side in the relaxed state.
Figure 21:
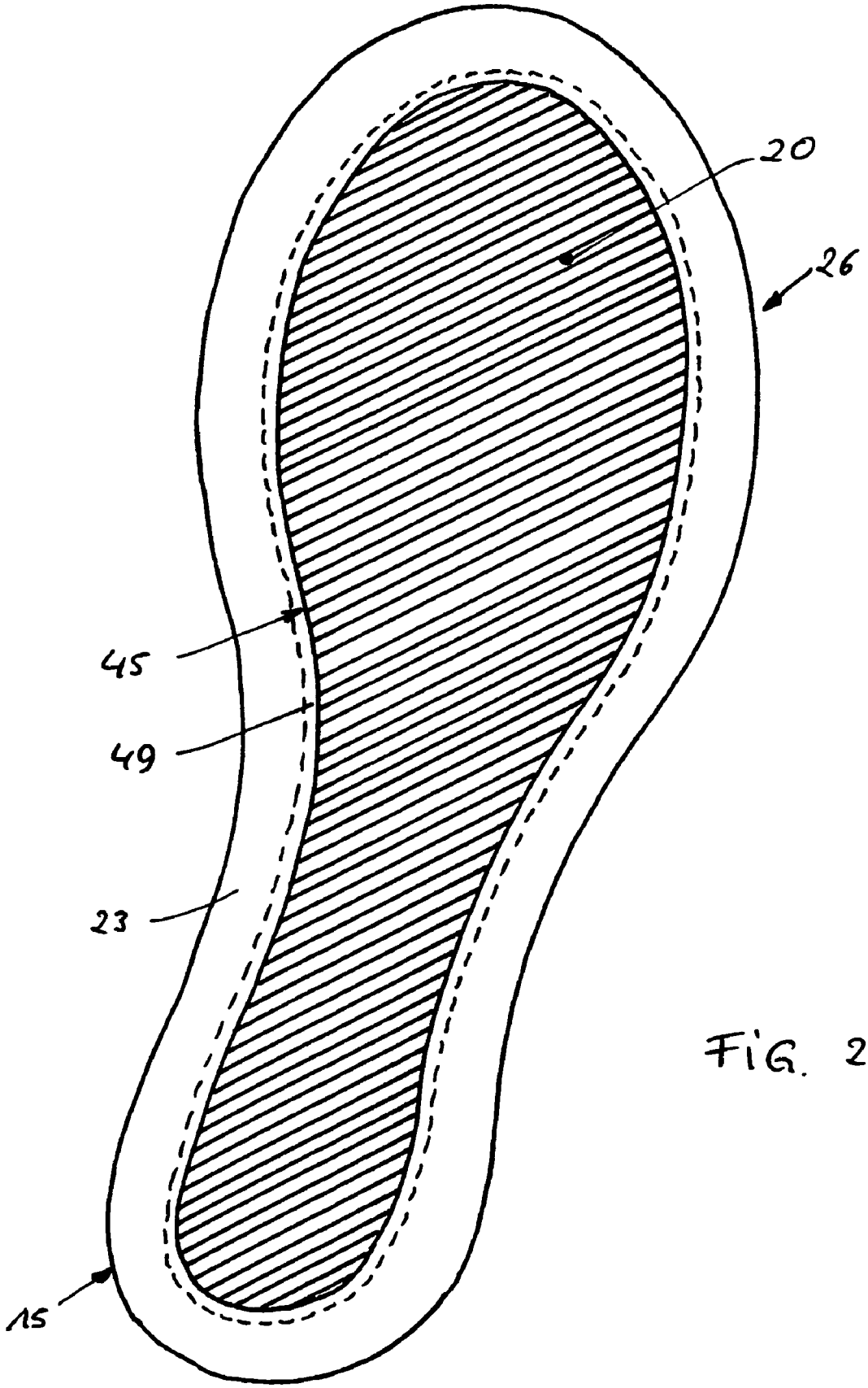
FIG. 21 shows a plan view from below of the functional layer part shown in FIG. 20 with tensioned elastic string-lasting.

Shown in FIGS. 17 to 19 and 22 to 31 are embodiments of the invention in which an outer-material end region on the sole side is angled away and sewn to the peripheral edge of a sole. FIGS. 20 and 21 show an embodiment of a functional layer part which is particularly suitable for these embodiments of the invention.

Figure 17:
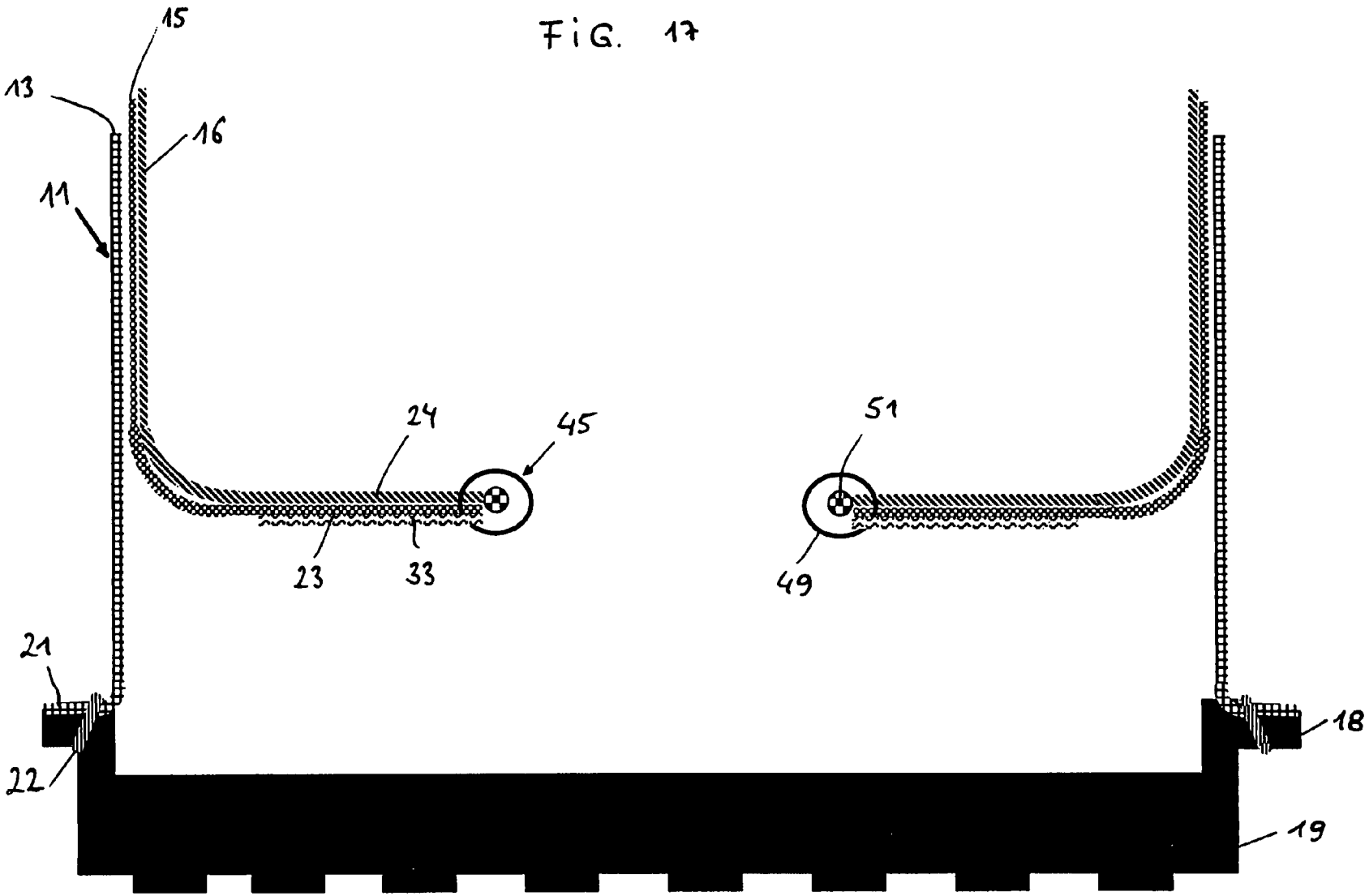
FIG. 17 shows a twelfth embodiment of the invention with a functional layer with an elastic string-lasting in a first production phase.
Figure 18:
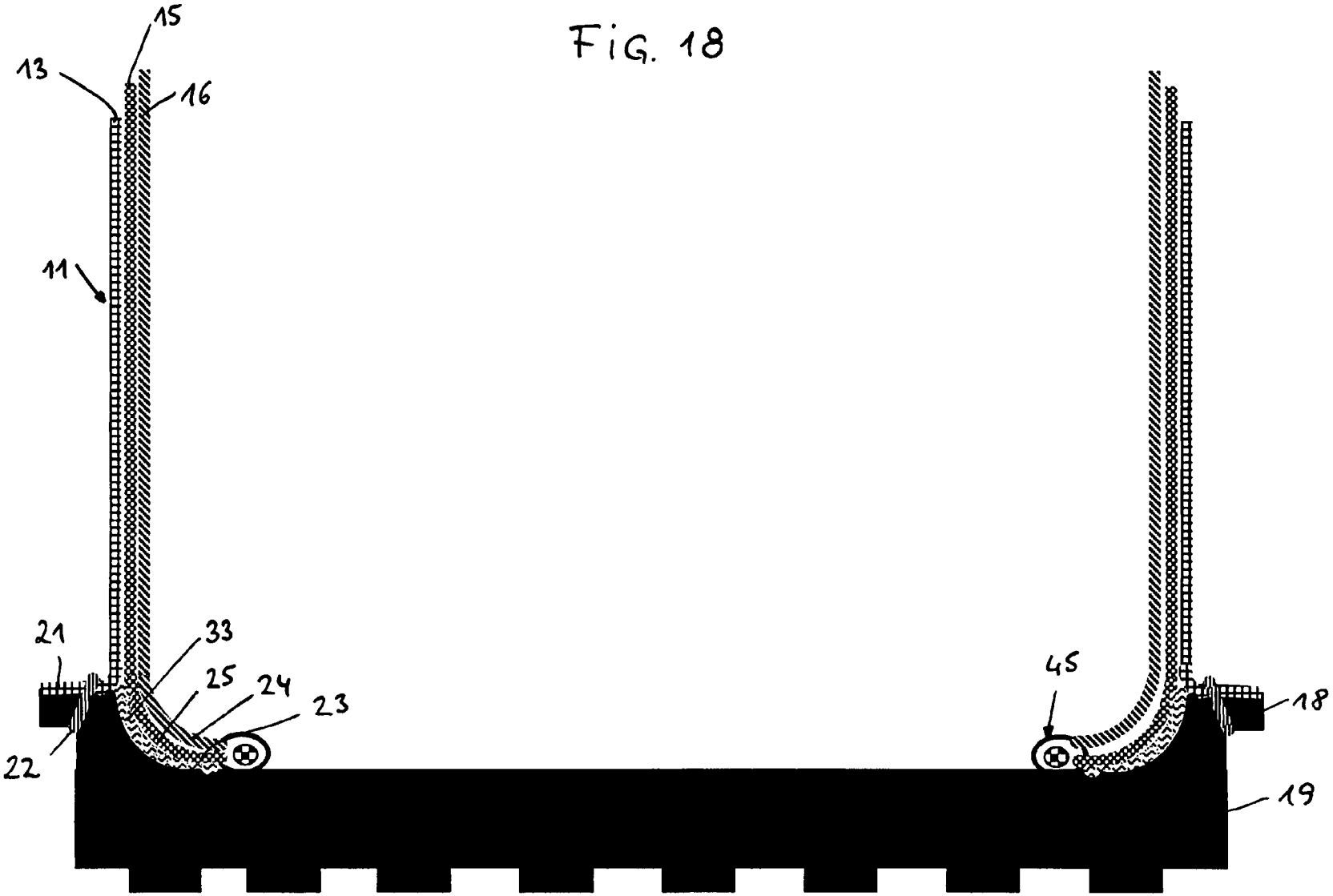
FIG. 18 shows the twelfth embodiment in a second production phase.
Figure 19:
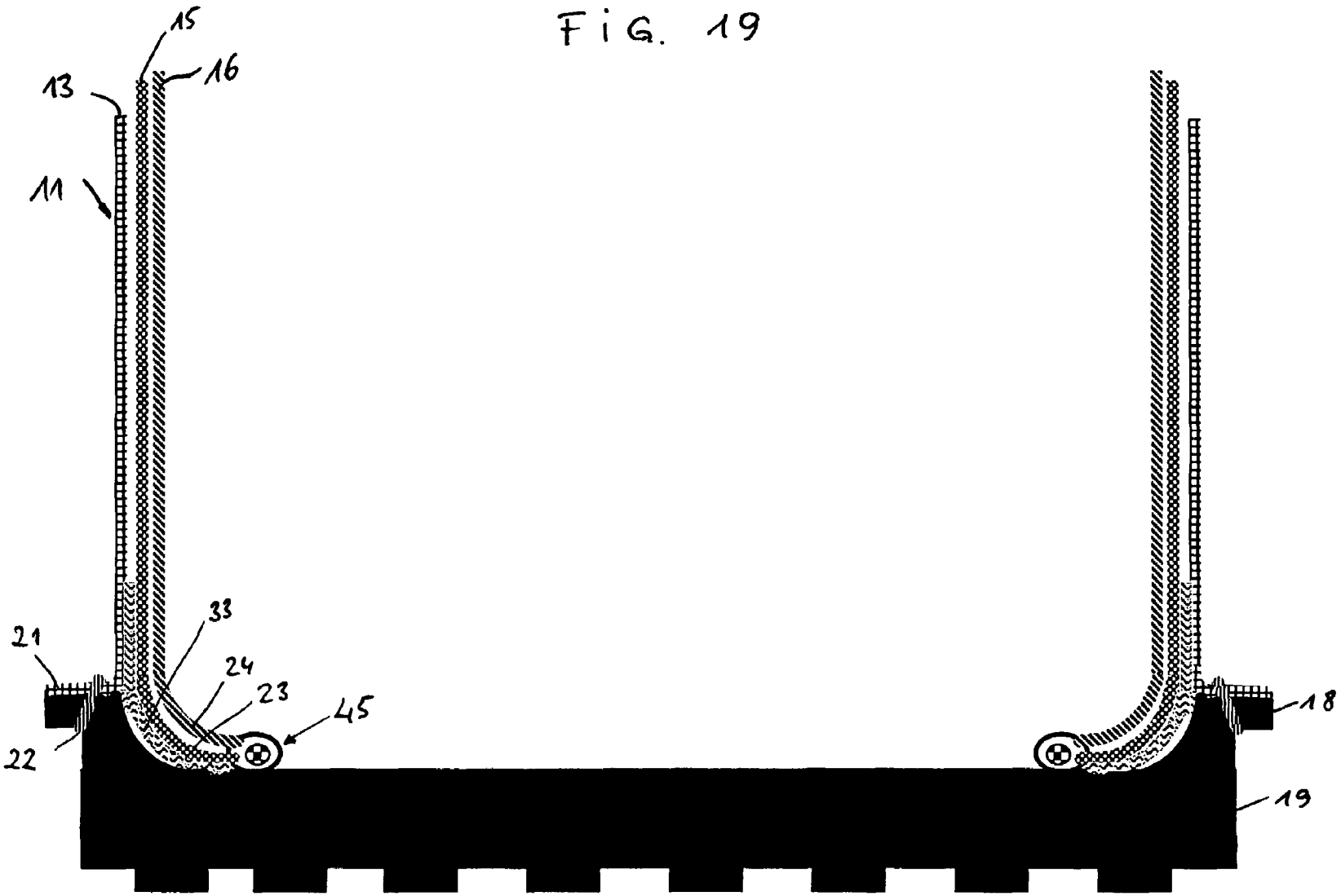
FIG. 19 shows a modification of the twelfth embodiment in the production phase shown in FIG. 18.

FIGS. 17 to 19 show in a highly schematized partial cross-sectional view a twelfth embodiment of the invention, with an upper 11 which is constructed with an outer material 13, a functional layer 15 arranged on the inner side of the latter and a lining 16 arranged on the inner side of the functional layer 15. An outwardly angled-away outer-material end region 21 on the sole side is securely sewn by means of a sole seam 22 to a likewise outwardly angled-away peripheral edge 18 of a dish-shaped outsole 19. A functional-layer end region 23 on the sole side and a lining end region 24 on the sole side are sewn to a string-lasting 45, which comprises a string tunnel 49 and a string 51 located in it. In the region adjoining the string-lasting 45, the underside of the functional-layer end region facing the outsole 19 is provided with not yet reacted reactive hot-melt adhesive 33.

In the production phase of the twelfth embodiment, shown in FIG. 17, the functional-layer end region 23 and the lining end region 24 have been clearly lifted off the outsole 19. The reason for this is that the string-lasting 45 in this embodiment of the invention is formed by an elastic string-lasting, by means of which the functional-layer end region 23 and the lining end region 24 are pretensioned toward the center of the outsole. This leads to the intended lifting of the functional-layer end region 23 and the lining end region 24 off the outsole 19, in order to keep the functional-layer end region 23 away from the sewing needle creating the sole seam 22 during the sewing of the sole seam 22. This ensures that the sewing needle does not unintentionally perforate the functional layer 15, which would cause the shoe to be unwaterproof.

In the production phase shown in FIG. 18, the reactive hot-melt adhesive 33 has adhesively bonded with the opposite region of the outsole 19. This has been achieved by inserting into the interior of the lining 16 a last (not represented), by means of which the functional-layer end region 23 and the lining end region 24 have been pressed against the elastic force of the elastic string-lasting 45 down toward the outsole 19 in such a way that the reactive hot-melt adhesive 33 has come into contact with the outsole 19. While the last was inside the lining 16, the reactive hot-melt adhesive 33 was activated to bring about its curing reaction.

In this embodiment, a reactive hot-melt adhesive 33 with which carbon or metal particles have been admixed is used for example, so that activation heat can be supplied to the reactive hot-melt adhesive 33 by irradiation, for example infrared irradiation or microwave irradiation.

In the production phase shown in FIG. 18, the last has already been removed again.

While in the embodiment shown in FIG. 18 the reactive hot-melt adhesive 33 reaches only as far as the upper edge of the outsole 19, in the modification of the twelfth embodiment, shown in FIG. 19, the reactive hot-melt adhesive 33 extends beyond the upper edge of the outsole 19. It is important, and adequate, for the waterproofness of footwear of this type, that at least part of the region of the functional-layer end region 23 adjoining the string-lasting 45 is sealed with reactive hot-melt adhesive 33.

FIGS. 20 and 21 show in a schematized plan view from below an embodiment of a functional layer part 26 with an elastic string-lasting 45 which is advantageous for the embodiment shown in FIGS. 17 to 19. In this case, FIG. 20 shows the functional layer part 26 with relaxed string-lasting 45, which leads to a drawing together of the functional-layer end region 23 with the indicated gathering folds. In FIG. 21, the functional layer part 26 is stretched over a last 20, which leads to an extension of the elastic string-lasting 45 and the tensioning of the functional-layer end region 23.

Shown in FIGS. 20 and 21 is a functional layer part 26 which has not yet been provided with reactive hot-melt adhesive 33.

A thirteenth embodiment, in which a functional layer part 26 of the type shown in FIGS. 20 and 21 is used, is now explained on the basis of FIGS. 22-25. In this case, FIGS. 22-25 show different production phases of this embodiment. A cross section through the front foot region of the footwear according to this embodiment is represented in each case in a schematized way.

This embodiment also concerns footwear in which the outer material 13 of the upper has an outwardly angled-away outer-material end region 21 which is joined to an outsole, here a plate-shaped outsole 39, by means of a sole seam 22.

FIG. 22 shows a production phase of this footwear in which the outwardly angled-away outer-material end region 21 of the outer material 13 is initially fixed by means of adhesive 35 to a peripheral edge 53 of the outsole 39. This adhesive 35 may be, for example, conventional solvent-based adhesive of the type already mentioned above.

Inside the outer material 13 there is the functional layer part 26 of the type shown in FIGS. 20 and 21, but already provided with reactive hot-melt adhesive 33, to be precise on the outer side of the functional layer part 26 facing the outer material 13, alongside the string-lasting 45. On account of the elasticity of the string-lasting 45, the end region on the sole side of the functional layer part 26 has been pulled away from the end region on the sole side of the outer material 13, so that in the production phase shown in FIG. 23 the sole seam 22 can be provided without the risk of perforation of the functional layer part 26. At least during the production of the sole seam 22, there is therefore no last inside the functional layer part 26.

Once the sole seam 22 has been produced, the footwear is stretched over a last 20, which leads to tensioning of the elastic string-lasting 45 and consequently stretching of the functional layer part 26, in such a way that the reactive hot-melt adhesive 33 comes into contact with the top side of the outsole 39, facing the last 20. In this state of the footwear, the reactive hot-melt adhesive 33 becomes adhesively reactive, that is to say it is exposed to conditions which initiate its crosslinking reaction. For example, reactive hot-melt adhesive 33 with which carbon or metal particles have been admixed is used, and the activation takes place by infrared radiation or microwave radiation being directed onto the reactive hot-melt adhesive. The carbon or metal particles in this case act like small heating elements which heat the reactive hot-melt adhesive from the inside and bring it to the activation temperature.

Once the reactive hot-melt adhesive 33 has been adhesively bonded with the outsole 39, which leads to a waterproof sealing of the end region on the sole side of the functional layer part 26, the last 20 is removed from the footwear. To complete the footwear, an insole 55 is then also arranged over the outsole 39 and the end region on the sole side of the functional layer part 26, for example it is cemented there. This brings us to a production phase such as that shown in FIG. 25.

Shown in FIGS. 26-31 are various production phases of a fourteenth embodiment of footwear according to the invention, in which an outwardly angled-away outer-material end region is not sewn to an outsole but to an intermediate sole. In this embodiment too, a functional layer part 26 of the type shown in FIGS. 20 and 21 with flexible string-lasting is used.

In the production phase shown in FIG. 26, the adhesive bonding of the outwardly angled-away outer-material end region 21 to a peripheral edge 57 of an intermediate sole 59 takes place by means of adhesive 35. This production phase can be carried out with the last 20 inserted into the footwear or—in a way corresponding to FIG. 22 of the thirteenth embodiment—without inserted last 20. What is important is that, in the production phase shown in FIG. 27, the footwear is not stretched over a last 20, in order that the elastic string-lasting 45 of the functional layer part 26 can pull the end region on the sole side of the latter away from the effective range of the sewing machine for sewing through the sole, by means of which the sole seam 22 is produced. As a result, in this embodiment too, the round needle of the sewing machine sewing through the sole is prevented from gripping and perforating the functional layer of the functional layer part 26. This risk would be particularly great on the inner side of the middle foot region of the footwear if the functional layer part 26 were not pulled away by means of the elastic string-lasting 45 from the area of the sewing machine sewing through the sole.

Once the sole seam 22 has been produced, the footwear is stretched over the last 20 (again), according to the production phase shown in FIG. 28, in order to stretch the functional layer part 26 counter to the pretensioning force of the elastic string-lasting 45 in such a way inside the outer material 13 that the reactive hot-melt adhesive 33 comes into contact with the top side of the intermediate sole 59 facing the last 20 and can be adhesively bonded with the intermediate sole 59 in a sealing manner by an activation process.

After the activation of the reactive hot-melt adhesive 33 has led to adequate adhesive bonding between the functional layer part 26 and the intermediate sole 59, the last 20 is removed again, as it is shown in FIG. 29. After that, an outsole 39 is fastened to the underside of the intermediate sole 59, for example by means of conventional outsole cement 35 in the form of solvent-based adhesive. This brings us to the production phase shown in FIG. 30. To complete the footwear, an insole 55 is then also attached in a way according to FIG. 31, for example by adhesive bonding (not represented) of the intermediate sole 55 to the end region on the sole side of the functional layer part 26 and the top side of the intermediate sole 39.

With a conventional, non-elastic string-lasting, it would not be possible with adequate certainty, at least when using conventional lasts, to keep the functional layer of the functional layer part 26 out of the effective range of the sewing machine sewing through the sole. This is because a conventional, non-elastic string-lasting must be stretched over a last by securely lashing the string of the string-lasting, and only then can the footwear be closed by attaching an outsole or intermediate sole. During the production of the sole seam 22, the functional layer is consequently in the direct proximity of the effective range of the round needle of the sewing machine sewing through the sole, with the already described risk of perforation of the functional layer.

The use according to the invention of a functional layer part 26 with elastic string-lasting overcomes this problem in a technically very simple way and using conventional lasts. The lashing together of the end region on the sole side of the functional layer part takes place already during the production of this functional layer part 26, that is by means of the elastic string-lasting. With the elasticity of the elastic string-lasting correctly set, not only is the functional layer kept adequately far out of the range of action of the round needle of the sewing machine sewing through the sole during the sewing of the seam 22 but it is also possible for the ultimately desired positioning of the functional layer part 26 to be achieved by means of the last 20 once the sole seam 22 has been produced.

In connection with the embodiments described in FIGS. 22 to 31, reference is made to a functional layer part 26 which has an elastic string-lasting 45. Instead of an elastic string-lasting, however, other elastic means may also be used to pretension the end region on the sole side of the functional layer part 26 toward the center of the outsole. For example, elastic tension may be achieved by an elastic band being sewn or cemented onto the peripheral edge on the sole side of the functional layer part 26.

The invention claimed is:

1. Footwear with an upper and a sole construction having an outsole, in which:

the upper is constructed with an outer material and with a waterproof functional layer at least partially lining the outer material on the inner side of the outer material and having an upper end region on the sole side with an outer-material end region and a functional-layer end region, the outsole is joined to the upper end region, the functional-layer end region has an edge region which is not covered by the outer-material end region or any connecting strip attached to the outer-material and an adhesive zone which is closed in the direction of the sole periphery and comprises a reactive hot-melt adhesive which brings about waterproofness when in the fully reacted state is applied to the edge region.

2. The footwear as claimed in claim 1, in which the edge region is formed by an overhang projecting beyond the outer material end region of the functional-layer end region.

3. The footwear as claimed in claim 2, with reactive hot-melt adhesive in the form of PU reactive hot-melt adhesive.

4. The footwear as claimed in claim 3, with reactive hot-melt adhesive, which contains particles which can be heated by means of irradiation.

5. The footwear as claimed in claim 4, in which the particles are selected from a particle group containing carbon particles and metal particles.

6. The footwear as claimed in claim 1, in which the outsole is adhesively bonded to the upper end region by means of outsole cement applied to it.

7. The footwear as claimed in claim 6, in which the reactive hot-melt adhesive extends over the entire edge region.

8. The footwear as claimed in claim 7, in which the upper end region extends essentially perpendicular to the tread of the outsole and the functional-layer end region projects beyond the outer-material end region in the direction of the tread.

9. The footwear as claimed in claim 7, in which the upper end region extends essentially parallel to the tread of the outsole and the functional-layer end region projects beyond the outer-material end region in the direction of the center of the outsole.

10. The footwear as claimed in claim 9, with an insole, to which the functional-layer end region is fastened.

11. The footwear as claimed in claim 10, in which the functional-layer end region is joined to the insole by means of a seam.

12. The footwear as claimed in claim 9, in which the functional-layer end region is kept essentially parallel to the tread of the outsole by means of a first string-lasting.

13. The footwear as claimed in claim 12, in which the outer-material end region is fastened to the functional layer by means of fixing adhesive.

14. The footwear as claimed in claim 13, in which the overhang is bridged by a connecting strip of a material permeable to liquid reactive hot-melt adhesive and the reactive hot-melt adhesive has been applied to an outer side of the connecting strip.

15. The footwear as claimed in claim 14, in which the connecting strip is constructed with a gauze strip.

16. The footwear as claimed in claim 15, in which a first longitudinal side of the gauze strip is fastened to the outer-material end region.

17. The footwear as claimed in claim 16, in which the first longitudinal side of the gauze strip is sewn to the outer-material end region.

18. The footwear as claimed in claim 17, in which a second longitudinal side of the gauze strip is fastened to the functional-layer end region.

19. The footwear as claimed in claim 18, in which the second longitudinal side of the gauze strip is sewn to the functional-layer end region.

20. The footwear as claimed in claim 19, in which the second longitudinal side of the gauze strip is fastened to the insole.

21. The footwear as claimed in claim 20, in which the second longitudinal side of the gauze strip is sewn to the insole.

22. The footwear as claimed in claim 19, in which the second longitudinal side of the gauze strip is fastened to the first string-lasting holding the functional-layer end region.

23. The footwear as claimed in claim 22, in which the second longitudinal side of the gauze strip is sewn to the first string-lasting holding the functional-layer end region.

24. The footwear as claimed in claim 23, in which the outer-material end region is kept essentially parallel to the tread of the outsole by means of a second string-lasting.

25. The footwear as claimed in claim 24, in which the outer-material end region is provided with an elastic drawstring, which pulls the outer-material end region toward the center of the outsole.

26. The footwear as claimed in claim 25, in which the elastic drawstring is formed by an elastic string-lasting, which has an elastic string which pretensions the outer-material end region toward the center of the outsole.

27. The footwear as claimed in claim 26, in which the functional-layer end region is provided with an elastic drawstring, which pretensions the functional-layer end region toward the center of the outsole.

28. The footwear as claimed in claim 27, in which the elastic drawstring is formed by an elastic string-lasting, which has an elastic string which pretensions the functional-layer end region toward the center of the outsole.

29. The footwear as claimed in claim 28, in which the outer-material end region is angled away outward and sewn to the peripheral edge of a sole.

30. The footwear as claimed in claim 29, in which the sole is formed by the outsole.

31. The footwear as claimed in claim 29, in which the sole is formed by an intermediate sole.

32. The footwear as claimed in claim 31, in which the outsole is fastened to the intermediate sole.

33. The footwear as claimed in claim 32, in which a functional layer is provided in the form of a waterproof and water-vapor-permeable functional layer.

34. The footwear as claimed in claim 33, with a functional layer constructed with expanded, microporous polytetrafluoroethylene.

35. The footwear as claimed in claim 34, in which the outsole is essentially in the form of a dish, with a sheet-like tread region and an upturned edge rising up essentially perpendicularly from the latter.

36. The footwear as claimed in claim 34, in which the outsole is essentially in the form of a sheet.

37. The footwear of claim 1, wherein the functional layer end region ends vertical to the outsole.

38. A process for producing footwear, having the following production steps:

an upper is created, constructed with an outer material and with a waterproof functional layer at least partially lining the outer material on the inner side of the latter and provided with an upper end region on the sole side;

the outer material is provided with an outer-material end region on the sole side and the functional layer is provided with a functional-layer end region on the sole side, the functional-layer end region being provided with an edge region which is not covered by the outer-material end region or any connecting strip attached to the outer-material;

an adhesive zone which is closed in the direction of the sole periphery and comprises a reactive hot-melt adhesive which brings about waterproofness when in the fully reacted state is applied to the edge region;

an outsole is fastened to the upper end region.

39. The process as claimed in claim 36, in which the edge region is formed by an overhang of the functional-layer end region projecting beyond the outer-material end region.

40. The process as claimed in claim 39, in which the functional-layer end region is tensioned by means of a first string-lasting which is essentially parallel to the tread of the outsole.

41. The process as claimed in claim 40, in which the first string-lasting is provided with an elastic string, which pretensions the functional-layer end region toward the center of the outsole.

42. The process as claimed in claim 40, in which the overhang is bridged by a connecting strip of a material permeable to liquid reactive hot-melt adhesive and the reactive hot-melt adhesive is applied to an outer side of the connecting strip.

43. The process as claimed in claim 42, in which a connecting strip is attached in the form of a gauze strip.

44. The process as claimed in claim 43, in which a first longitudinal side of the gauze strip is sewn to the outer-material end region and a second longitudinal side of the gauze strip is sewn to the functional-layer end region.

45. The process as claimed in claim 44, in which the sole construction is provided with an insole.

46. The process as claimed in claim 45, in which the second longitudinal side of the gauze strip is sewn to the insole.

47. The process as claimed in claim 43, in which the second longitudinal side of the gauze strip is sewn to the string-lasting.

48. The process as claimed in claim 47, in which the outer-material end region is tensioned by means of a second string-lasting essentially parallel to the tread of the outsole.

49. The process as claimed in claim 41, in which the outer-material end region is angled away outward and fastened to the peripheral edge of a sole.

50. The process as claimed in claim 49, in which the angled-away outer-material end region is fastened to the peripheral region of the outsole.

51. The process as claimed in claim 49, in which the angled-away outer-material end region is fastened to the peripheral edge of an intermediate sole, to the underside of which the outsole is fastened.

52. The process as claimed in claim 51, with the following production steps:

a) the functional-layer end region is provided with a string-lasting with an elastic string;
b) the overhang of the functional-layer end region is provided on its outer side facing the sole with reactive hot-melt adhesive;
c) the functional layer provided with string-lasting and reactive hot-melt adhesive is arranged inside the outer material;
d) the outwardly angled-away outer-material end region is fastened to the peripheral edge of the sole;
e) the upper joined to the sole is stretched onto a last in such a way that the reactive hot-melt adhesive comes into contact with the sole;
f) the reactive hot-melt adhesive is adhesively bonded with the sole.

53. The process as claimed in claim 52, in which the outwardly angled-away outer-material end region is adhesively bonded to the peripheral edge of the sole.

54. The process as claimed in claim 53, in which the outwardly angled-away outer-material end region is sewn to the peripheral edge of the sole.

55. The process as claimed in claim 54, in which the angled-away outer-material end region is fastened to an intermediate sole.

56. The process as claimed in claim 55, in which a) the upper having the outer material and the functional layer is stretched over a last;
b) the outwardly angled-away outer-material end region is adhesively bonded to the peripheral edge of the intermediate sole;
c) the outer is removed from the last;
d) the outwardly angled-away outer-material end region is sewn to the peripheral edge of the intermediate sole;
e) the upper sewn to the intermediate sole is stretched once again onto the last in such a way that the reactive hot-melt adhesive comes into contact with the intermediate sole;
f) the reactive hot-melt adhesive is adhesively bonded with the intermediate sole.

57. The process as claimed in claim 54, in which the outwardly angled-away outer-material region is fastened to the outsole.

58. The process as claimed in claim 57, in which a) the outwardly angled-away outer-material end region is adhesively bonded to the peripheral edge of the outsole;
b) the outwardly angled-away outer-material end region is sewn to the peripheral edge of the outsole;
c) the upper sewn to the outsole is stretched over a last in such a way that the reactive hot-melt adhesive comes into contact with the outsole;
d) the reactive hot-melt adhesive is adhesively bonded with the outsole.

59. The process as claimed in claim 58, in which, after the adhesive bonding of the reactive hot-melt adhesive and the removal of the last from the upper, an insole covering the functional-layer end region and the sole is attached inside the functional layer.

60. The process as claimed in claim 48, in which, after being applied to the overhang or the gauze strip, the reactive hot-melt adhesive is pressed against the surface of the overhang or of the gauze strip by a pressing device with a pressing surface not adhesively bonding with the reactive hot-melt adhesive.

61. The process as claimed in claim 60, in which a reactive hot-melt adhesive which can cure by means of moisture is used, being applied to the region to be sealed and exposed to moisture to make it fully react.

62. The process as claimed in claim 61, in which a reactive hot-melt adhesive which can be thermally activated and can be cured by means of moisture is used, being thermally activated, applied to the region to be sealed and exposed to moisture to make it fully react.

63. The process as claimed in claim 61, in which a reactive hot-melt adhesive which can be thermally activated is applied in the non-activated state to the overhang and is thermally activated only at the time at which the adhesive bonding of the reactive hot-melt adhesive is intended to take place.

64. The process as claimed in claim 63, in which reactive hot-melt adhesive which contains particles which can be heated by means of irradiation is applied to the overhang, radiation heating the particles being directed onto the reactive hot-melt adhesive at the time at which the adhesive bonding of the reactive hot-melt adhesive is intended to take place.

65. The process as claimed in claim 64, in which reactive hot-melt adhesive containing metal particles is used and microwave radiation is directed onto the reactive hot-melt adhesive.

66. The process as claimed in claim 64, in which reactive hot-melt adhesive containing carbon particles is used and infrared radiation is directed onto the reactive hot-melt adhesive.

67. The process as claimed in claim 66, in which a waterproof and water-vapor-permeable functional layer is used.

68. The process as claimed in claim 67, in which a functional layer constructed with expanded, microporous polytetrafluoroethylene is used.

69. The process as claimed in claim 57, in which, after the adhesive bonding of the reactive hot-melt adhesive and the removal of the last from the upper, an insole covering the functional-layer end region and the sole is attached inside the functional layer.

* * * * *